US007926300B2

(12) United States Patent
Roberts et al.

(10) Patent No.: US 7,926,300 B2
(45) Date of Patent: Apr. 19, 2011

(54) ADAPTIVE ADJUSTMENT OF LIGHT OUTPUT OF SOLID STATE LIGHTING PANELS

(75) Inventors: John K. Roberts, Grand Rapids, MI (US); Keith J. Vadas, Lake Worth, FL (US); Chenhua You, Cary, NC (US)

(73) Assignee: Cree, Inc., Durham, NC (US)

( * ) Notice: Subject to any disclaimer, the term of this patent is extended or adjusted under 35 U.S.C. 154(b) by 415 days.

(21) Appl. No.: 11/368,976

(22) Filed: Mar. 6, 2006

(65) Prior Publication Data

US 2007/0115662 A1 May 24, 2007

Related U.S. Application Data

(60) Provisional application No. 60/738,305, filed on Nov. 18, 2005, provisional application No. 60/749,133, filed on Dec. 9, 2005.

(51) Int. Cl.
*F21S 19/00* (2006.01)
*F21V 7/04* (2006.01)

(52) U.S. Cl. ..... 62/612; 362/227; 362/228; 362/230; 362/276

(58) Field of Classification Search ..... 362/555, 362/561, 227, 230, 228, 276, 802, 800; 345/82, 345/84, 597

See application file for complete search history.

(56) References Cited

U.S. PATENT DOCUMENTS

| | | | |
|---|---|---|---|
| 3,927,290 | A | 12/1975 | Denley |
| 4,329,625 | A | 5/1982 | Nishizawa et al. |
| 5,150,016 | A | 9/1992 | Sawase et al. |
| 5,264,997 | A | 11/1993 | Hutchisson et al. |
| 5,783,909 | A | 7/1998 | Hochstein |
| 5,959,316 | A | 9/1999 | Lowery |
| 6,078,148 | A | 6/2000 | Hochstein |
| 6,095,666 | A | 8/2000 | Salam |
| 6,127,784 | A | 10/2000 | Grossman et al. |
| 6,153,985 | A | 11/2000 | Grossman |
| 6,236,331 | B1 | 5/2001 | Dussureault |
| 6,285,139 | B1 | 9/2001 | Ghanem |
| 6,292,901 | B1 | 9/2001 | Lys et al. |

(Continued)

FOREIGN PATENT DOCUMENTS

EP 1 081 771 A2 3/2001

(Continued)

OTHER PUBLICATIONS

U.S. Appl. No. 60/749,133, filed Dec. 9, 2005, Roberts.

(Continued)

*Primary Examiner* — Ismael Negron
(74) *Attorney, Agent, or Firm* — Myers Bigel Sibley & Sajovec

(57) ABSTRACT

A lighting panel system includes a lighting panel including a first string of solid state lighting devices configured to emit light at a first wavelength and a second string of solid state lighting devices configured to emit light at a second wavelength, different from the first wavelength, and a current supply circuit configured to supply a drive current to the first string in response to a control signal. A photosensor is arranged to receive light emitted by the panel, and a control system is configured to sample an output signal of the photosensor and adjust the control signal responsive thereto to thereby adjust an average current supplied to the first string by the current supply circuit. Methods of operating a lighting panel are also provided.

11 Claims, 11 Drawing Sheets

U.S. PATENT DOCUMENTS

| | | | | |
|---|---|---|---|---|
| 6,335,538 | B1 | 1/2002 | Prutchi et al. | |
| 6,350,041 | B1 | 2/2002 | Tarsa et al. | |
| 6,357,889 | B1 | 3/2002 | Duggal et al. | |
| 6,362,578 | B1 | 3/2002 | Swanson et al. | |
| 6,411,046 | B1 | 6/2002 | Muthu | |
| 6,441,558 | B1 | 8/2002 | Muthu et al. | |
| 6,495,964 | B1 | 12/2002 | Muthu et al. | |
| 6,498,440 | B2 | 12/2002 | Stam et al. | |
| 6,510,995 | B2 | 1/2003 | Muthu et al. | |
| 6,576,881 | B2 | 6/2003 | Muthu et al. | |
| 6,576,930 | B2 | 6/2003 | Reeh et al. | |
| 6,608,614 | B1 | 8/2003 | Johnson | |
| 6,624,350 | B2 | 9/2003 | Nixon et al. | |
| 6,630,801 | B2 | 10/2003 | Schuurmans | |
| 6,633,301 | B1 * | 10/2003 | Dallas et al. | 345/597 |
| 6,674,060 | B2 | 1/2004 | Antila | |
| 6,741,351 | B2 | 5/2004 | Marshall et al. | |
| 6,809,347 | B2 | 10/2004 | Tasch et al. | |
| 6,836,081 | B2 | 12/2004 | Swanson et al. | |
| 6,841,804 | B1 | 1/2005 | Chen et al. | |
| 6,841,947 | B2 | 1/2005 | Berg-johansen | |
| 6,936,857 | B2 | 8/2005 | Doxsee et al. | |
| 7,009,343 | B2 | 3/2006 | Lim et al. | |
| 7,023,543 | B2 | 4/2006 | Cunningham | |
| 7,093,958 | B2 | 8/2006 | Coushaine | |
| 7,135,664 | B2 | 11/2006 | Vornsand et al. | |
| 7,140,752 | B2 | 11/2006 | Ashdown | |
| 7,173,384 | B2 | 2/2007 | Plotz et al. | |
| 7,186,000 | B2 | 3/2007 | Lebens et al. | |
| 7,202,608 | B2 | 4/2007 | Robinson et al. | |
| 7,208,713 | B2 | 4/2007 | Ishiguchi | |
| 7,213,940 | B1 | 5/2007 | Van de Ven et al. | |
| 7,256,557 | B2 | 8/2007 | Lim et al. | |
| 7,262,558 | B2 | 8/2007 | Hsu | |
| 7,315,139 | B1 | 1/2008 | Selvan et al. | |
| 7,339,323 | B2 | 3/2008 | Bucur | |
| 7,518,319 | B2 | 4/2009 | Konno et al. | |
| 7,521,879 | B2 | 4/2009 | Hong et al. | |
| 7,586,271 | B2 | 9/2009 | Shuy | |
| 7,595,786 | B2 | 9/2009 | Shih | |
| 7,712,917 | B2 | 5/2010 | Roberts et al. | |
| 7,804,478 | B2 | 9/2010 | Schou | |
| 2001/0035853 | A1 | 11/2001 | Hoelen et al. | |
| 2002/0070914 | A1 | 6/2002 | Bruning et al. | |
| 2002/0190972 | A1 | 12/2002 | Ven de Van | |
| 2003/0011832 | A1 | 1/2003 | Chang | |
| 2003/0089918 | A1 | 5/2003 | Hiller et al. | |
| 2003/0117798 | A1 | 6/2003 | Leysath | |
| 2003/0230991 | A1 | 12/2003 | Muthu et al. | |
| 2004/0212998 | A1 | 10/2004 | Mohacsi | |
| 2005/0062446 | A1 | 3/2005 | Ashdown | |
| 2005/0099478 | A1 | 5/2005 | Iwase | |
| 2005/0259439 | A1 | 11/2005 | Cull et al. | |
| 2005/0274972 | A1 | 12/2005 | Roth et al. | |
| 2006/0049781 | A1 | 3/2006 | Lee et al. | |
| 2006/0105482 | A1 | 5/2006 | Alferink | |
| 2006/0214174 | A1 | 9/2006 | Shirakuma et al. | |
| 2006/0256049 | A1 * | 11/2006 | Schou | 345/82 |
| 2007/0040512 | A1 | 2/2007 | Jungwirth et al. | |
| 2007/0052375 | A1 | 3/2007 | Lin et al. | |
| 2007/0216704 | A1 | 9/2007 | Roberts et al. | |
| 2007/0247414 | A1 | 10/2007 | Roberts | |

FOREIGN PATENT DOCUMENTS

| | | |
|---|---|---|
| EP | 1152 642 | 4/2001 |
| EP | 1 111 966 | 6/2001 |
| EP | 1 548 573 | 12/2003 |
| EP | 1 589 519 | 4/2005 |
| FR | 2 854 252 | 4/2003 |
| JP | 2-75197 | 3/1990 |
| JP | 2004/286971 | 10/2004 |
| JP | 2005-302737 | 10/2005 |
| WO | WO 98/43014 | 10/1998 |
| WO | WO 00/34709 | 6/2000 |
| WO | WO 2005/021323 A2 | 3/2005 |
| WO | WO 2007/061758 A1 | 5/2007 |

OTHER PUBLICATIONS

"Invitation to Pay Additional Fees" for corresponding International Application No. PCT/US2006/044511, mailed May 7, 2007.

International Search Report and Written Opinion for PCT/US2006/044511; Sep. 11, 2007.

International Search Report and Written Opinion for PCT/US2008/005827 dated Nov. 21, 2008.

Perduijn et al., "Light Output Feedback Solution for RGB LED Backlight Applications", 22 pages, SID Digest (2000).

Narendran et al., "Solid-State Lighting: Failure Analysis of White LED's", Journal of Crystal Growth, vol. 268:3-4 (Aug. 2004).

Zhu et al., "Optimizing the Performance of Remote Phosphor LED", First International Conference on White LED's and Solid State Lighting, PW-48 (Nov. 26-30, 2007).

European Search Report (8 pages) corresponding to European Application No. 06845870.2; Dated: Nov. 6, 2008.

International Search Report and Written Opinion (9 pages) corresponding to International Application No. PCT/US07/12707; Mailing Date: Aug. 21, 2008.

International Search Report and Written Opinion (12 pages) corresponding to International Application No. PCT/US06/48521; Mailing Date: Feb. 7, 2008.

U.S. Appl. No. 11/755,149, filed May 30, 2007, Van De Ven.

U.S. Appl. No. 11/613,692, filed Dec. 20, 2006, Negley.

U.S. Appl. No. 12/257,804, filed Oct. 24, 2008, Negley.

Official Action corresponding to Japanese Patent Application No. 2008-541343 dated Dec. 14, 2010; 8 pages.

* cited by examiner

ADAPTIVE ADJUSTMENT OF LIGHT OUTPUT OF SOLID STATE LIGHTING PANELS

CROSS-REFERENCE TO RELATED APPLICATIONS

The present application claims the benefit of and priority to U.S. Provisional Patent Application No. 60/738,305, filed Nov. 18, 2005, entitled *System and Method for Interconnection and Integration of LED Backlighting Modules*, and U.S. Provisional Patent Application No. 60/749,133, filed Dec. 9, 2005, entitled *Solid State Backlighting Unit Assembly and Methods*, the disclosures of which are hereby incorporated herein by reference as if set forth their entireties.

FIELD OF THE INVENTION

The present invention relates to solid state lighting, and more particularly to adjustable solid state lighting panels and to systems and methods for adjusting the light output of solid state lighting panels.

BACKGROUND

Solid state lighting arrays are used for a number of lighting applications. For example, solid state lighting panels including arrays of solid state lighting devices have been used as direct illumination sources, for example, in architectural and/or accent lighting. A solid state lighting device may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small liquid crystal display (LCD) display screens, such as LCD display screens used in portable electronic devices. In addition, there has been increased interest in the use of solid state lighting panels as backlights for larger displays, such as LCD television displays.

For smaller LCD screens, backlight assemblies typically employ white LED lighting devices that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

The color rendering index of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

For large-scale backlight and illumination applications, it is often desirable to provide a lighting source that generates a white light having a high color rendering index, so that objects and/or display screens illuminated by the lighting panel may appear more natural. Accordingly, such lighting sources may typically include an array of solid state lighting devices including red, green and blue light emitting devices. When red, green and blue light emitting devices are energized simultaneously, the resulting combined light may appear white, or nearly white, depending on the relative intensities of the red, green and blue sources. There are many different hues of light that may be considered "white." For example, some "white" light, such as light generated by sodium vapor lighting devices, may appear yellowish in color, while other "white" light, such as light generated by some fluorescent lighting devices, may appear more bluish in color.

The chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature. Accordingly, a white point may be identified by a correlated color temperature (CCT) of the light source, which is the temperature at which the heated black-body radiator matches the hue of the light source. White light typically has a CCT of between about 4000 and 8000K. White light with a CCT of 4000 has a yellowish color, while light with a CCT of 8000K is more bluish in color.

For larger display and/or illumination applications, multiple solid state lighting tiles may be connected together, for example, in a two dimensional array, to form a larger lighting panel. Unfortunately, however, the hue of white light generated may vary from tile to tile, and/or even from lighting device to lighting device. Such variations may result from a number of factors, including variations of intensity of emission from different LEDs, and/or variations in placement of LEDs in a lighting device and/or on a tile. Accordingly, in order to construct a multi-tile display panel that produces a consistent hue of white light from tile to tile, it may be desirable to measure the hue and saturation, or chromaticity, of light generated by a large number of tiles, and to select a subset of tiles having a relatively close chromaticity for use in the multi-tile display. This may result in decreased yields and/or increased inventory costs for a manufacturing process.

Moreover, even if a solid state display/lighting tile has a consistent, desired hue of light when it is first manufactured, the hue and/or brightness of solid state devices within the tile may vary non-uniformly over time and/or as a result of temperature variations, which may cause the overall color point of the panel to change over time and/or may result in non-uniformity of color across the panel. In addition, a user may wish to change the light output characteristics of a display panel in order to provide a desired hue and/or brightness level.

SUMMARY

A lighting panel system according to some embodiments of the invention includes a lighting panel including at least a first string of solid state lighting devices configured to emit light at a first dominant wavelength and a second string of solid state lighting devices configured to emit light at a second dominant wavelength, different from the first dominant wavelength, and a current supply circuit configured to supply an on-state drive current to the first string upon receipt of a control signal. A photosensor is arranged to receive light from at least one solid state lighting device in the first string, and a control system is configured to receive an output signal from the photosensor and to adjust the control signal responsive to the output signal of the photosensor to thereby adjust an average current supplied to the first string by the current supply circuit, such that the photosensor, the control system and the current supply circuit thereby form a feedback loop for the lighting panel.

The current supply circuit may include a closed loop variable voltage boost converter current source.

The control system may be configured to sample the output of the photosensor when current is not being supplied to the first string of solid state lighting devices or the second string of solid state lighting devices to obtain an ambient light value. The control system may be configured to increase average current to the first string as the ambient light value increases. The control system may be configured to sample the photosensor during an interval in which current is being supplied to the first string and/or the second string in order to obtain a display brightness value. This display brightness value may be representative of the display luminance resulting from backlight illumination alone or in combination with ambient illumination. Alternately or additionally, this display brightness value may be representative of the perceivable display brightness resulting from backlight illumination alone or in combination with ambient illumination. The control system may be configured to decrease the average current to the first string as display brightness value increases.

The control system may be further configured to sample the output of the photosensor when current is not being supplied to the first string of solid state lighting devices or the second string of solid state lighting devices to obtain an ambient light value. The control system may be configured to adjust the average current supplied to the first LED string based on the ambient light value and the display brightness value.

The control system may be configured to adjust the average current supplied to the first LED string based on a difference between the ambient light value and the display brightness value. Alternatively or additionally, the control system may be configured to adjust the average current supplied to the first LED string based on a ratio of the ambient light value and the display brightness value.

The control system may be configured to maintain an average luminosity of the first string independent of an ambient/background illumination, and/or the control system may be configured to maintain a relationship between an ambient/background illumination and an average luminosity of the first string by providing a positive feedback signal with respect to the ambient light value and a negative feedback signal with respect to the display brightness value.

The control system may be configured to employ digital incremental logic in the feedback loop. In particular, the digital incremental logic may reference indices in a lookup table. The control system may be configured to employ proportional control in the feedback loop.

The control signal may include a pulse width modulation (PWM) signal, and the control system may be configured to control an average current supplied to the first string by varying a duty cycle of the PWM signal. The duty cycle of the PWM signal may correspond to a value of a register in the control system.

In some embodiments, the control system may be configured to control an average current supplied to the first string by varying a pulse frequency of the control signal.

The current supply circuit may be configured to maintain the on-state current supplied to the first string at a substantially constant value even as the control system varies the average current supplied to the first string by a mechanism such as variable duty cycle pulse width modulation.

The dominant wavelength of the first string may remain more constant at various average current levels than if the average current was manipulated using a variable current.

Likewise, the luminous flux per unit power dissipated by the first string may remain more constant at various average current levels than if the average current was manipulated using a variable current.

The control system may further include a color management unit coupled to the photosensor and configured to sample and process the output signal of the photosensor and to provide the processed output signal to the control system.

The lighting panel system may further include a temperature sensor configured to sense a temperature associated with the lighting panel, and the control system may be configured to adjust an average current supplied to the first string in response to a change in the sensed temperature.

The lighting panel system may further include a current supply circuit configured to supply an on-state drive current to the second string upon receipt of a second control signal, and the control system may be further configured to adjust the second control signal responsive to the output signal of the photosensor.

A lighting panel system according to some further embodiments of the invention includes a lighting panel including at least a first string of solid state lighting devices configured to emit light at a first dominant wavelength and a second string of solid state lighting devices configured to emit light at a second dominant wavelength, different from the first dominant wavelength, a first current supply circuit configured to supply an on-state drive current to the first string upon receipt of a first control signal, a second current supply circuit configured to supply an on-state drive current to the second string upon receipt of a second control signal, and a photosensor arranged to receive light from at least one solid state lighting device in the first string and at least one solid state lighting device in the second string. A control system is configured to receive an output signal from the photosensor and to adjust the first control signal and/or the second control signal responsive to the output signal of the photosensor to thereby adjust an average current supplied to the first string by the first current supply circuit and/or to adjust an average current supplied to the second string by the second current supply circuit. The photosensor, the control system and the first and second current supply circuits form a feedback loop for the lighting panel. The first and second control signals may include pulse width modulation (PWM) signals, and the control system may be configured to control an average current supplied to the first and/or second string by varying a duty cycle of the first and/or second control signal.

A leading edge of a pulse of the first control signal may occur at a different time from a leading edge of a pulse of the second control signal. In particular, in some embodiments, an external power factor of the lighting panel may be more balanced than if the leading edges of the pulses of the first and second control signals were to occur at substantially the same moment. Furthermore, the combined conducted or radiated EMI/RFI emissions of the first and second strings may have an amplitude at one or more frequencies that is less than if the leading edges of the pulses of the first and second control signals were to occur at substantially the same moment.

The leading edge of the pulse of the first control signal may be delayed from the leading edge of the pulse of the second control signal by a fixed delay.

The leading edge of the pulse of the first control signal may be delayed from the leading edge of the pulse of the second control signal by a variable delay. The variable delay interval may change within a prescribed range of delay intervals where the interval is random, chaotic or determined by a sweep function, table or other technique. The variable delay interval may alternately or additionally also be dependent on the pulse width of the first control signal and/or the second control signal.

A lighting panel system according to some other embodiments of the invention includes a lighting panel including first and second pulsed LED light sources configured to emit narrow band optical radiation having a first dominant wavelength when energized and third and fourth pulsed LED light sources configured to emit narrow band optical radiation having a second dominant wavelength when energized, the second dominant wavelength being different from the first dominant wavelength. The system further includes a photosensor configured to be responsive to light including the first and second dominant wavelengths and configured to provide substantially independent outputs related to the sensed illumination levels in the first and second dominant wavelengths. First, second, third and fourth current sources are configured to supply current to the first, second, third and fourth pulsed LED light sources, respectively, in response to control signals. A control system is coupled to the lighting panel and to the photosensor and is configured to provide a feedback loop from the photosensor to the lighting panel by sampling the photosensor output and, responsive to the photosensor output samples, providing control signals to the first and second current sources to thereby adjust an average current supplied to at least the first and second pulsed LED light sources.

The control system may be further configured to maintain the first and second pulsed LED light sources at different average current levels from one another and to maintain the third and fourth pulsed LED light sources at different average current levels than one another. The current sources may be configured to provide a first on-state current level to the first and second pulsed LED light sources and to provide a second on-state current level, different from the first on-state current level, to the third and fourth pulsed LED light sources. The control system may be further be configured to set a ratio of average current levels between the first and second pulsed LED light sources, and to set a ratio of average current levels between the third and fourth pulsed LED light sources. The control system may be further configured to maintain a ratio of average current levels between the first and second pulsed LED light sources relatively constant while varying the average current level to the first and second pulsed LED light sources and without appreciably changing the on-state current of the first and second pulsed LED light sources. The control system may be further configured to maintain a ratio of average current levels between the third and fourth pulsed LED light sources relatively constant while varying the average current level to the third and fourth pulsed LED light sources and without appreciably changing the on-state current of the third and fourth pulsed LED light sources.

The control system may be configured to alter average current levels of the first and second pulsed LED light sources in order to maintain a white point, chromaticity coordinate and/or luminance of the lighting panel, and/or to maintain the luminance contrast of the lighting panel relative to ambient illumination levels.

Some embodiments of the invention provide an LCD backlight for an LCD display having a visible area with a diagonal size greater than 17". The LCD backlight includes a plurality of strings of red, green and blue emitting LEDs arranged in a two-dimensional surface that may be substantially parallel to a display surface of the LCD display. In a particular embodiment, a boundary encompassing the plurality of strings of red, green and blue emitting LEDs arranged in the two-dimensional surface has an area greater than about 30% of the visible area of the LCD display. An average power dissipated by the LEDs may be less than about 0.3 Watts per square inch over the boundary of the two-dimensional surface, and an average luminance of the LCD backlight at maximum brightness adjustment may be greater than 200 Nit at 22 degrees C. ambient temperature when set to at least one white point with a correlated color temperature of between 4000k and 8000k, but more preferably is greater than about 250 nit or more.

In particular embodiments of the lighting panel system, for a given color, an average luminous flux generated by LEDs nearest an edge of the LCD display may be greater than an average luminous flux from all LEDs of that color within the LCD backlight. This may be accomplished, for example, by utilizing LED chips with greater efficiency in portions of the LCD backlight near the edges of the LCD display or by supplying an increased amount of power to LEDs near the edges of the LCD display. This aspect of the lighting panel system may be used to compensate for optical effects that would otherwise cause the edges of the display to appear less bright or different in color than other portions of the display.

Likewise in particular embodiments of the lighting panel system, for a given color, an average power dissipated by LEDs nearest the edge of the display may be greater than the average power dissipated by all LEDs of that color in the LCD backlight. This aspect of the lighting panel system may be used to compensate for optical effects that would otherwise cause the edges of the display to appear less bright or different in color than other portions of the display.

In particular embodiments of the lighting panel system, for a given color, an average power dissipated by LEDs nearest a bottom of the display may be less than an average power dissipated by all LEDs of that color within the LCD backlight. This aspect of the lighting panel system may be used to compensate for thermal effects that would otherwise cause the bottom of the display to appear brighter or different in color than other portions of the display.

Similarly, in particular embodiments of the control lighting panel system, for a given color, an average luminous flux generated per unit of power dissipated at a given junction temperature for LEDs nearest a bottom edge of the display may be less than an average luminous flux generated per unit of power dissipated at a given junction temperature for all LEDs of that color within the LCD backlight. This aspect of the lighting panel system may be used to compensate for thermal effects that would otherwise cause the bottom of the display to appear brighter or different in color than other portions of the display.

An LCD backlight system according to further embodiments of the invention includes a lighting panel including a plurality of tiles, each of the plurality of tiles having thereon a plurality red, green and blue LED chips arranged in RGB clusters on a substrate. The LED chips in the lighting panel are electrically connected into a plurality of red, green and blue LED strings. The lighting panel includes a plurality of constant current sources, each configured to energize a different LED string in response to a corresponding control signal. An average luminance of the lighting panel at maximum brightness adjustment may be greater than 200 Nit at 22 deg C. ambient temperature when set to a white point with a correlated color temperature of between 4000k and 8000k, but more preferably is greater than about 250 nit or more.

The constant current sources may be configured, in response to second control signals, to energize different LED strings of a same color at different on-state current levels.

According to some embodiments of the invention, methods of operating a lighting panel including first and second strings of solid state lighting devices configured to emit light having first and second dominant wavelengths, respectively, are provided. The method include supplying a first pulsed drive current the first string, the first drive current having a first pulse width at a pulse repetition rate, supplying a second pulsed drive current the second string, the second drive current having a second pulse width at the pulse repetition rate, sensing a light output from the lighting panel, and adjusting the first pulse width in response to the sensed light output.

Sensing the light output from the lighting panel may include sampling the output of a photosensor to obtain an ambient light value when current is not being supplied to the first string or the second string.

The methods may further include increasing an average current to the first string as the ambient light value increases.

Sensing the light output from the lighting panel may include sampling the photosensor during an interval in which current is being supplied to the first string and/or the second string in order to obtain a display brightness value.

The methods may further include decreasing the average current to the first string as display brightness value increases.

The methods may further include sampling the output of the photosensor when current is not being supplied to the first string of solid state lighting devices or the second string of solid state lighting devices to obtain an ambient light value.

The methods may further include adjusting the average current supplied to the first LED string based on the ambient light value and the display brightness value.

The methods may further include adjusting the average current supplied to the first LED string based on a difference between the ambient light value and the display brightness value.

The methods may further include adjusting the average current supplied to the first LED string based on a ratio of the ambient light value and the display brightness value.

The methods may further include maintaining an average luminosity of the first string independent of an ambient/background illumination.

The methods may further include maintaining a relationship between an ambient/background illumination and an average luminosity of the first string by providing a positive feedback signal with respect to the ambient light value and a negative feedback signal with respect to the display brightness value.

The methods may further include employing digital incremental logic in the feedback loop. Employing the digital incremental logic may include referencing indices in a lookup table.

The methods may further include employing proportional control in the feedback loop.

The control signal may include a pulse width modulation (PWM) signal, and the method may further include controlling an average current supplied to the first string by varying a duty cycle of the PWM signal.

The duty cycle of the PWM signal may correspond to a value of a register in a control system.

The methods may further include controlling an average current supplied to the first string by varying a pulse frequency of the control signal.

The methods may further include maintaining the on-state current supplied to the first string at a substantially constant value, and maintaining an average current supplied to the first string substantially constant.

The methods may further include sensing a temperature associated with the lighting panel, and adjusting an average current supplied to the first string in response to a change in the sensed temperature.

The methods may further include supplying an on-state drive current to the second string upon receipt of a second control signal, and adjusting the second control signal responsive to the output signal of the photosensor.

According to some embodiments of the invention, a lighting panel system includes a lighting panel including a plurality of bar assemblies, at least a first string of solid state lighting devices configured to emit light at a first dominant wavelength and a second string of solid state lighting devices configured to emit light at a second dominant wavelength, different from the first dominant wavelength, in each of the plurality of bar assemblies, a plurality of current supply circuits configured to supply an on-state drive current to a corresponding string upon receipt of a respective one of a plurality of control signals. One or more photosensors such as photodiodes, phototransistors, charge coupled devices (CCD's), CMOS photosensors or the like are arranged to receive light from the first and second strings of a corresponding bar assembly. In a particular embodiment, one or more photosensors is used in combination with one or more spectrally selective filters to enhance sensitivity of the sensor to a particular color such as red, green or blue. A control system is configured to receive an output signal from the photosensors and to adjust the control signals responsive to the output signals of the photosensors to thereby adjust an average current supplied to the strings by the current supply circuits.

The lighting panel system may further include a plurality of light guides configured to receive light from a corresponding bar assembly and to transmit the received light to a corresponding photosensor.

The light guides may extend through the bar assemblies, and the photosensors may be disposed on faces of the respective bar assemblies opposite to faces of the respective bar assemblies on which the solid state lighting devices are disposed.

A lighting panel system according to further embodiments of the invention includes a lighting panel including a plurality of bar assemblies, at least a first string of solid state lighting devices configured to emit light at a first dominant wavelength and a second string of solid state lighting devices configured to emit light at a second dominant wavelength, different from the first dominant wavelength, in each of the plurality of bar assemblies, a plurality of current supply circuits configured to supply an on-state drive current to a corresponding string upon receipt of a respective one of a plurality of control signals. A photosensor is arranged to receive light from each of the bar assemblies, and a control system is configured to receive an output signal from the photosensor and to adjust the control signals responsive to the output signal of the photosensors to thereby adjust an average current supplied to the strings by the current supply circuits.

The lighting panel system may further include a plurality of light guides configured to receive light from a corresponding bar assembly and to transmit the received light to the photosensor.

The lighting panel system may further include an optical switch, the plurality of light guides extend from respective locations relative to the bar assemblies to the optical switch, and the optical switch may be configured to controllably switch light output from the light guides to the photosensor.

The lighting panel system may further include a light combiner, and the plurality of light guides may extend from respective locations relative to the bar assemblies to the light combiner. The optical combiner may be configured to combine light output from the light guides and transmit the combined light to the photosensor.

Some embodiments of the invention provide methods of calibrating a lighting panel including a plurality of segments, each of said segments configured to emit a first color light and a second color light in response to pulse width modulated control signals applied thereto. The methods include, for each color, measuring a luminance of each segment at a duty cycle and calculating a nominal luminance ratio including a ratio of a total luminance of each color divided by a total luminance of the lighting panel. For each segment, a luminance ratio for each color is calculated including a ratio of a total luminance of a color of a respective segment to a total luminance of the respective segment. A variation of illuminance ratios from the nominal illuminance ratio is determined for each segment and for each color, and in response to at least one variation of illuminance ratios from the nominal illuminance ratio exceeding a threshold, a duty cycle of at least one color of at least one segment is adjusted to reduce the at least one variation of illuminance ratios from the nominal illuminance ratio.

Each segment may include a group of tiles and/or may include a bar of tiles. Furthermore, the first duty cycle comprises a maximum duty cycle.

Determining a variation of illuminance ratios from the nominal illuminance ratio for each segment and for each color may include determining a maximum variation of illuminance ratios from the nominal illuminance ratio for each segment and for each color.

Calculating a luminance ratio for each color may include determining a total luminance for each segment for each color.

Adjusting a duty cycle of at least one color of at least one segment may include selecting a color/segment with a lowest relative luminance, and multiplying a duty cycle by a coefficient generated based on the luminance of the selected color/segment.

The methods may further include determining a luminance variation of each color/segment to a center luminance average, and in response to a luminance variation to the center luminance average exceeding a second threshold, adjusting a duty cycle of at least one color of at least one segment to reduce the luminance variation to the center luminance average.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS OF THE INVENTION

Figure 1:
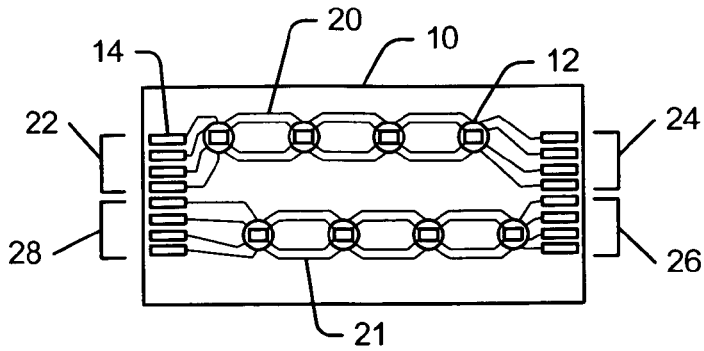
FIG. 1 is a front view of a solid state lighting tile in accordance with some embodiments of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Referring now to FIG. 1, a solid state lighting tile 10 may include thereon a number of solid state lighting elements 12 arranged in a regular and/or irregular two dimensional array. The tile 10 may include, for example, a printed circuit board (PCB) on which one or more circuit elements may be mounted. In particular, a tile 10 may include a metal core PCB (MCPCB) including a metal core having thereon a polymer coating on which patterned metal traces (not shown) may be formed. MCPCB material, and material similar thereto, is commercially available from, for example, The Bergquist Company. The PCB may further include heavy clad (4 oz. copper or more) and/or conventional FR-4 PCB material with thermal vias. MCPCB material may provide improved thermal performance compared to conventional PCB material. However, MCPCB material may also be heavier than conventional PCB material, which may not include a metal core.

In the embodiments illustrated in FIG. 1, the lighting elements 12 are multi-chip clusters of four solid state emitting devices per cluster. In the tile 10, four lighting elements 12 are serially arranged in a first path 20, while four lighting elements 12 are serially arranged in a second path 21. The lighting elements 12 of the first path 20 are connected, for example via printed circuits, to a set of four anode contacts 22 arranged at a first end of the tile 10, and a set of four cathode contacts 24 arranged at a second end of the tile 10. The lighting elements 12 of the second path 21 are connected to a set of four anode contacts 26 arranged at the second end of the tile 10, and a set of four cathode contacts 28 arranged at the first end of the tile 10.

Figure 2:
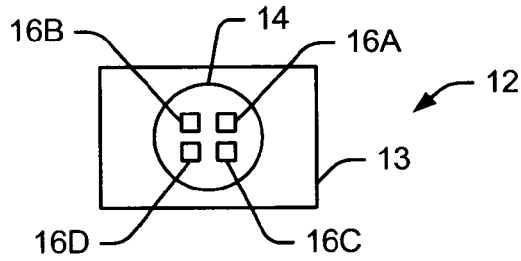
FIG. 2 is a top view of a packaged solid state lighting device including a plurality of LEDs in accordance with some embodiments of the invention.

The solid state lighting elements 12 may include, for example, organic and/or inorganic light emitting devices. An example of a solid state lighting element 12' for high power illumination applications is illustrated in FIG. 2. A solid state lighting element 12' may comprise a packaged discrete electronic component including a carrier substrate 13 on which a plurality of LED chips 16A-16D are mounted. In other embodiments, one or more solid state lighting elements 12 may comprise LED chips 16A-16D mounted directly onto electrical traces on the surface of the tile 10, forming a multi-chip module or chip on board assembly. Suitable tiles are disclosed in commonly assigned U.S. Provisional Patent Application Ser. No. 60/749,133 entitled "SOLID STATE BACKLIGHTING UNIT ASSEMBLY AND METHODS" filed Dec. 9, 2005.

The LED chips 16A-16D may include at least a red LED 16A, a green LED 16B and a blue LED 16C. The blue and/or green LEDs may be InGaN-based blue and/or green LED chips available from Cree, Inc., the assignee of the present invention. The red LEDs may be, for example, AlInGaP LED chips available from Epistar, Osram and others. The lighting device 12 may include an additional green LED 16D in order to make more green light available.

In some embodiments, the LEDs 16 may have a square or rectangular periphery with an edge length of about 900 μm or greater (i.e. so-called "power chips." However, in other embodiments, the LED chips 16 may have an edge length of 500 μm or less (i.e. so-called "small chips"). In particular, small LED chips may operate with better electrical conversion efficiency than power chips. For example, green LED chips with a maximum edge dimension less than 500 microns and as small as 260 microns, commonly have a higher electrical conversion efficiency than 900 micron chips, and are known to typically produce 55 lumens of luminous flux per Watt of dissipated electrical power and as much as 90 lumens of luminous flux per Watt of dissipated electrical power.

As further illustrated in FIG. 2, the LEDs 16A-16D may be covered by an encapsulant 14, which may be clear and/or may include light scattering particles, phosphors, and/or other elements to achieve a desired emission pattern, color and/or intensity. While not illustrated in FIG. 2, the lighting device 12 may further include a reflector cup surrounding the LEDs 16A-16D, a lens mounted above the LEDs 16A-16D, one or more heat sinks for removing heat from the lighting device, an electrostatic discharge protection chip, and/or other elements.

Figure 3:
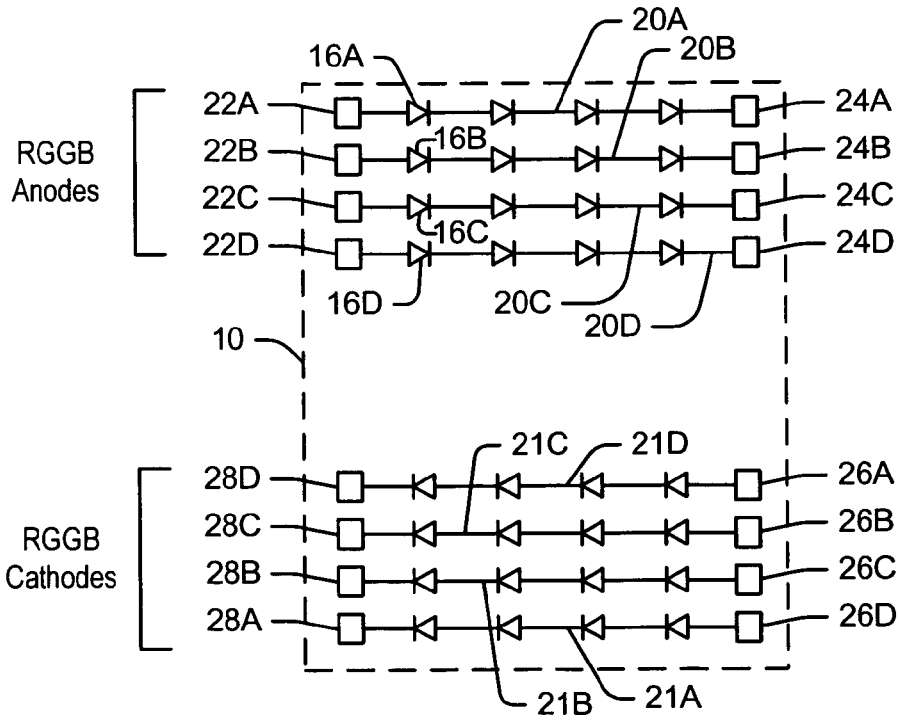
FIG. 3 is a schematic circuit diagram illustrating the electrical interconnection of LEDs in a solid state lighting tile in accordance with some embodiments of the invention.

LED chips 16A-16D of the lighting elements 12 in the tile 10 may be electrically interconnected as shown in the schematic circuit diagram in FIG. 3. As shown therein, the LEDs may be interconnected such that the blue LEDs 16A in the first path 20 are connected in series to form a string 20A. Likewise, the first green LEDs 16B in the first path 20 may be arranged in series to form a string 20B, while the second green LEDs 16D may be arranged in series to form a separate string 20D. The red LEDs 16C may be arranged in series to form a string 20C. Each string 20A-20D may be connected to an anode contact 22A-22D arranged at a first end of the tile 10 and a cathode contact 24A-24D arranged at the second end of the tile 10, respectively.

A string 20A-20D may include all, or less than all, of the corresponding LEDs in the first path 20 or the second path 21. For example, the string 20A may include all of the blue LEDs from all of the lighting elements 12 in the first path 20. Alternatively, a string 20A may include only a subset of the corresponding LEDs in the first path 20. Accordingly the first path 20 may include four serial strings 20A-20D arranged in parallel on the tile 10.

The second path 21 on the tile 10 may include four serial strings 21A, 21B, 21C, 21D arranged in parallel. The strings 21A to 21D are connected to anode contacts 26A to 26D, which are arranged at the second end of the tile 10 and to cathode contacts 28A to 28D, which are arranged at the first end of the tile 10, respectively.

It will be appreciated that, while the embodiments illustrated in FIGS. 1-3 include four LED chips 16 per lighting device 12 which are electrically connected to form at least four strings of LEDs 16 per path 20, 21, more and/or fewer than four LED chips 16 may be provided per lighting device 12, and more and/or fewer than four LED strings may be provided per path 20, 21 on the tile 10. For example, a lighting device 12 may include only one green LED chip 16B, in which case the LEDs may be connected to form three strings per path 20, 21. Likewise, in some embodiments, the two green LED chips in a lighting device 12 may be connected in serial to one another, in which case there may only be a single string of green LED chips per path 20, 22. Further, a tile 10 may include only a single path 20 instead of plural paths 20, 21 and/or more than two paths 20, 21 may be provided on a single tile 10.

Figure 4A:
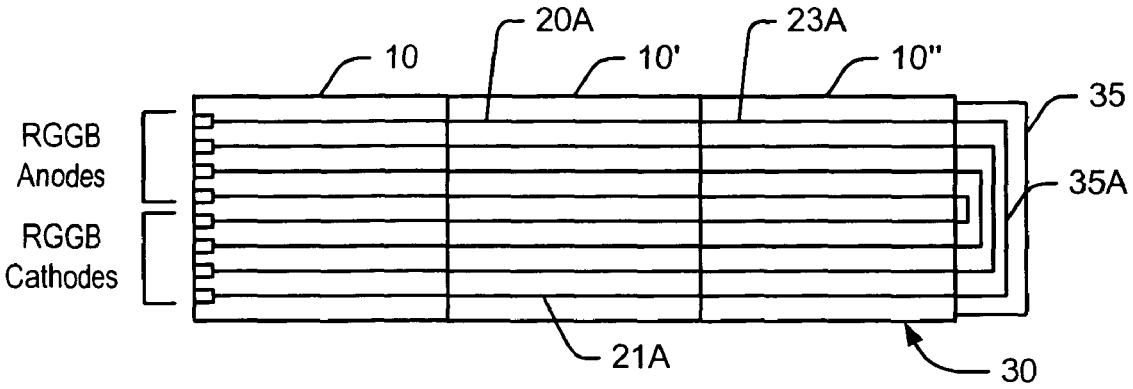
FIG. 4A is a front view of a bar assembly including multiple solid state lighting tiles in accordance with some embodiments of the invention.

Multiple tiles 10 may be assembled to form a larger lighting bar assembly 30 as illustrated in FIG. 4A. As shown therein, a bar assembly 30 may include two or more tiles 10, 10', 10" connected end-to-end. Accordingly, referring to FIGS. 3 and 4, the cathode contacts 24 of the first path 20 of the leftmost tile 10 may be electrically connected to the anode contacts 22 of the first path 20 of the central tile 10', and the cathode contacts 24 of the first path 20 of the central tile 10' may be electrically connected to the anode contacts 22 of the first path 20 of the rightmost tile 10", respectively. Similarly, the anode contacts 26 of the second path 21 of the leftmost tile 10 may be electrically connected to the cathode contacts 28 of the second path 21 of the central tile 10', and the anode contacts 26 of the second path 21 of the central tile 10' may be electrically connected to the cathode contacts 28 of the second path 21 of the rightmost tile 10", respectively.

Furthermore, the cathode contacts 24 of the first path 20 of the rightmost tile 10" may be electrically connected to the anode contacts 26 of the second path 21 of the rightmost tile 10" by a loopback connector 35. For example, the loopback connector 35 may electrically connect the cathode 24A of the string 20A of blue LED chips 16A of the first path 20 of the rightmost tile 10" with the anode 26A of the string 21A of blue LED chips of the second path 21 of the rightmost tile 10". In this manner, the string 20A of the first path 20 may be connected in serial with the string 21A of the second path 21 by a conductor 35A of the loopback connector 35 to form a single string 23A of blue LED chips 16. The other strings of the paths 20, 21 of the tiles 10, 10', 10" may be connected in a similar manner.

The loopback connector 35 may include an edge connector, a flexible wiring board, or any other suitable connector. In addition, the loop connector may include printed traces formed on/in the tile 10.

While the bar assembly 30 shown in FIG. 4A is a one dimensional array of tiles 10, other configurations are possible. For example, the tiles 10 could be connected in a two-dimensional array in which the tiles 10 are all located in the same plane, or in a three dimensional configuration in which the tiles 10 are not all arranged in the same plane. Furthermore the tiles 10 need not be rectangular or square, but could, for example, be hexagonal, triangular, or the like.

Figure 4B:
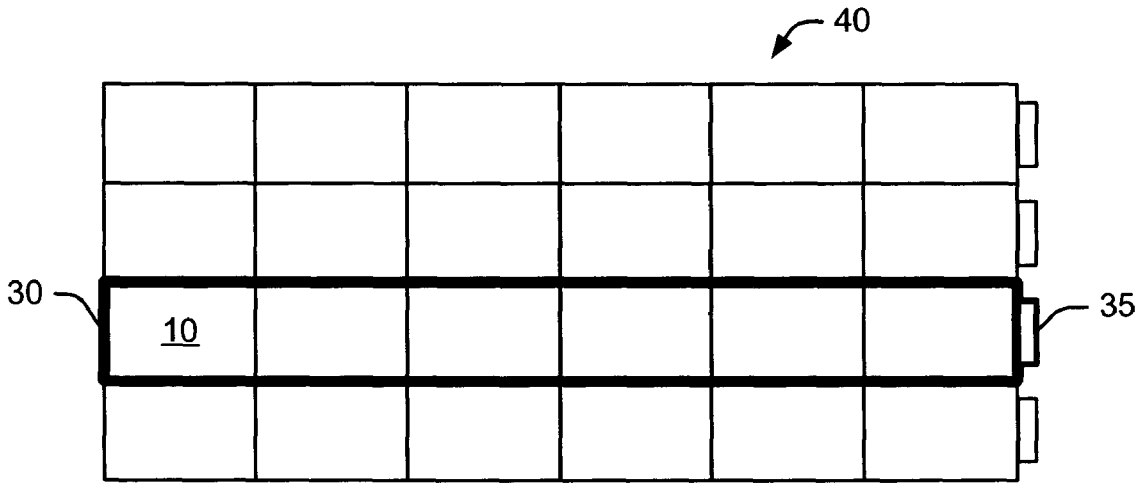
FIG. 4B is a front view of a lighting panel in accordance with some embodiments of the invention including multiple bar assemblies.

Referring to FIG. 4B, in some embodiments, a plurality of bar assemblies 30 may be combined to form a lighting panel 40, which may be used, for example, as a backlighting unit (BLU) for an LCD display. As shown in FIG. 4B, a lighting panel 40 may include four bar assemblies 30, each of which includes six tiles 10. The rightmost tile 10 of each bar assembly 30 includes a loopback connector 35. Accordingly, each bar assembly 30 may include four strings 23 of LEDs (i.e. one red, two green and one blue).

In some embodiments, a bar assembly 30 may include four LED strings 23 (one red, two green and one blue). Thus, a lighting panel 40 including nine bar assemblies may have 36 separate strings of LEDs. Moreover, in a bar assembly 30 including six tiles 10 with eight solid state lighting elements 12 each, an LED string 23 may include 48 LEDs connected in serial.

For some types of LEDs, in particular blue and/or green LEDs, the forward voltage (Vf) may vary by as much as +/−0.75V from a nominal value from chip to chip at a standard drive current of 20 mA. A typical blue or green LED may have a Vf of 3.2 Volts. Thus, the forward voltage of such chips may vary by as much as 25%. For a string of LEDs containing 48 LEDs, the total Vf required to operate the string at 20 mA may vary by as much as +/−36V.

Accordingly, depending on the particular characteristics of the LEDs in a bar assembly, a string of one light bar assembly (e.g. the blue string) may require significantly different operating power compared to a corresponding string of another bar assembly. These variations may significantly affect the color and/or brightness uniformity of a lighting panel that includes multiple tiles 10 and/or bar assemblies 30, as such Vf variations may lead to variations in brightness and/or hue from tile to tile and/or from bar to bar. For example, current differences from string to string may result in large differences in the flux, peak wavelength, and/or dominant wavelength output by a string. Variations in LED drive current on the order of 5% or more may result in unacceptable variations in light output from string to string and/or from tile to tile. Such variations may significantly affect the overall color gamut, or range of displayable colors, of a lighting panel.

In addition, the light output characteristics of LED chips may change during their operational lifetime. For example, the light output by an LED may change over time and/or with ambient temperature.

In order to provide consistent, controllable light output characteristics for a lighting panel, some embodiments of the invention provide a lighting panel having two or more serial strings of LED chips. An independent current control circuit is provided for each of the strings of LED chips. Furthermore, current to each of the strings may be individually controlled, for example, by means of pulse width modulation (PWM) and/or pulse frequency modulation (PFM). The width of pulses applied to a particular string in a PWM scheme (or the frequency of pulses in a PFM scheme) may be based on a pre-stored pulse width (frequency) value that may be modified during operation based, for example, on a user input and/or a sensor input.

Figure 5:
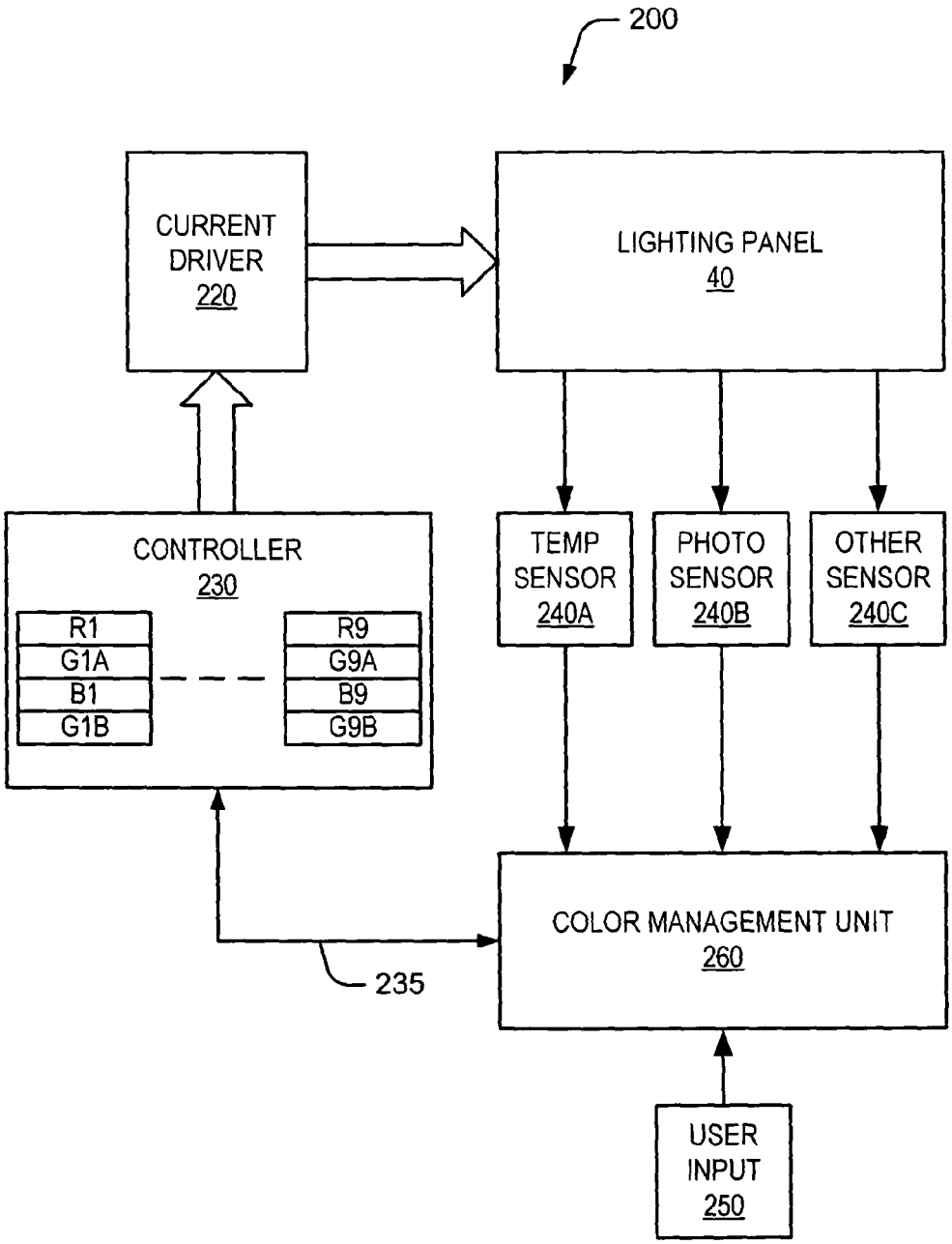
FIG. 5 is a schematic block diagram illustrating a lighting panel system in accordance with some embodiments of the invention.

Accordingly, referring to FIG. 5, a lighting panel system 200 is shown. The lighting panel system 200, which may be a backlight for an LCD display panel, includes a lighting panel 40. The lighting panel 40 may include, for example, a plurality of bar assemblies 30, which, as described above, may include a plurality of tiles 10. However, it will be appreciated that embodiments of the invention may be employed in conjunction with lighting panels formed in other configurations. For example, some embodiments of the invention may be employed with solid state backlight panels that include a single, large area tile.

In particular embodiments, however, a lighting panel 40 may include a plurality of bar assemblies 30, each of which may have four cathode connectors and four anode connectors corresponding to the anodes and cathodes of four independent strings 23 of LEDs each having the same dominant wavelength. For example, each bar assembly 23 may have a red string 23A, two green strings 23B, 23D, and a blue string 23C, each with a corresponding pair of anode/cathode contacts on one side of the bar assembly 30. In particular embodiments, a lighting panel 40 may include nine bar assemblies 30. Thus, a lighting panel 40 may include 36 separate LED strings.

A current driver 220 provides independent current control for each of the LED strings 23 of the lighting panel 40. For example, the current driver 220 may provide independent current control for 36 separate LED strings in the lighting panel 40. The current driver 220 may provide a constant current source for each of the 36 separate LED strings of the lighting panel 40 under the control of a controller 230. In some embodiments, the controller 230 may be implemented using an 8-bit microcontroller such as a PIC18F8722 from Microchip Technology Inc., which may be programmed to provide pulse width modulation (PWM) control of 36 separate current supply blocks within the driver 220 for the 36 LED strings 23.

Pulse width information for each of the 36 LED strings may be obtained by the controller 230 from a color management unit 260, which may in some embodiments include a color management controller such as the Agilent HDJD-J822-SCR00 color management controller.

The color management unit 260 may be connected to the controller 230 through an I2C (Inter-Integrated Circuit) communication link 235. The color management unit 260 may be configured as a slave device on an I2C communication link 235, while the controller 230 may be configured as a master device on the link 235. I2C communication links provide a low-speed signaling protocol for communication between integrated circuit devices. The controller 230, the color management unit 260 and the communication link 235 may together form a feedback control system configured to control the light output from the lighting panel 40. The registers R1-R9, etc., may correspond to internal registers in the controller 230 and/or may correspond to memory locations in a memory device (not shown) accessible by the controller 230.

The controller 230 may include a register, e.g. registers R1-R9, G1A-G9A, B1-B9, G1B-G9B, for each LED string 23, i.e. for a lighting unit with 36 LED strings 23, the color management unit 260 may include at least 36 registers. Each of the registers is configured to store pulse width information for one of the LED strings 23. The initial values in the registers may be determined by an initialization/calibration process. However, the register values may be adaptively changed over time based on user input 250 and/or input from one or more sensors 240 coupled to the lighting panel 40.

The sensors 240 may include, for example, a temperature sensor 240A, one or more photosensors 240B, and/or one or more other sensors 240C. In particular embodiments, a lighting panel 40 may include one photosensor 240B for each bar assembly 30 in the lighting panel. However, in other embodiments, one photosensor 240B could be provided for each LED string 30 in the lighting panel. In other embodiments, each tile 10 in the lighting panel 40 may include one or more photosensors 240B.

In some embodiments, the photosensor 240B may include photo-sensitive regions that are configured to be preferentially responsive to light having different dominant wavelengths. Thus, wavelengths of light generated by different LED strings 23, for example a red LED string 23A and a blue LED string 23C, may generate separate outputs from the photosensor 240B. In some embodiments, the photosensor 240B may be configured to independently sense light having dominant wavelengths in the red, green and blue portions of the visible spectrum. The photosensor 240B may include one or more photosensitive devices, such as photodiodes. The photosensor 240B may include, for example, an Agilent HDJD-S831-QT333 tricolor photo sensor.

Sensor outputs from the photosensors 240B may be provided to the color management unit 260, which may be configured to sample such outputs and to provide the sampled values to the controller 230 in order to adjust the register values for corresponding LED strings 23 in order to correct variations in light output on a string-by-string basis. In some embodiments, an application specific integrated circuit (ASIC) may be provided on each tile 10 along with one or more photosensors 240B in order to pre-process sensor data before it is provided to the color management unit 260. Furthermore, in some embodiments, the sensor output and/or ASIC output may be sampled directly by the controller 230.

The photosensors 240B may be arranged at various locations within the lighting panel 40 in order to obtain representative sample data. Alternatively and/or additionally, light guides such as optical fibers may be provided in the lighting panel 40 to collect light from desired locations. In that case, the photosensors 240B need not be arranged within an optical display region of the lighting panel 40, but could be provided, for example, on the back side of the lighting panel 40. Further, an optical switch may be provided to switch light from different light guides which collect light from different areas of the lighting panel 40 to a photosensor 240B. Thus, a single photosensor 240B may be used to sequentially collect light from various locations on the lighting panel 40.

The user input 250 may be configured to permit a user to selectively adjust attributes of the lighting panel 40, such as color temperature, brightness, hue, etc., by means of user controls such as input controls on an LCD panel.

The temperature sensor 240A may provide temperature information to the color management unit 260 and/or the controller 230, which may adjust the light output from the lighting panel on a string-to-string and/or color-to-color basis based on known/predicted brightness vs. temperature operating characteristics of the LED chips 16 in the strings 23.

Various configurations of photosensors 240B are shown in FIGS. 6A-6D. For example, in the embodiments of FIG. 6A, a single photosensor 240B is provided in the lighting panel 40. The photosensor 240B may be provided at a location where it may receive an average amount of light from more than one tile/string in the lighting panel.

Figure 6A:
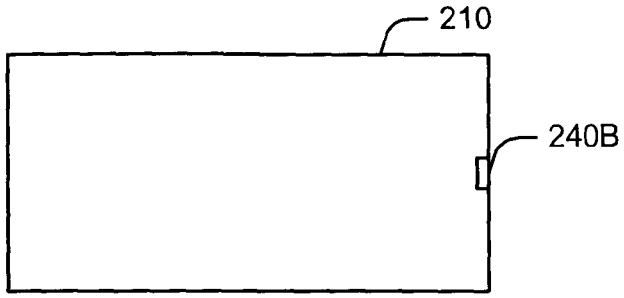
FIGS. 6A-6D are a schematic diagrams illustrating possible configurations of photosensors on a lighting panel in accordance with some embodiments of the invention.
Figure 6B:
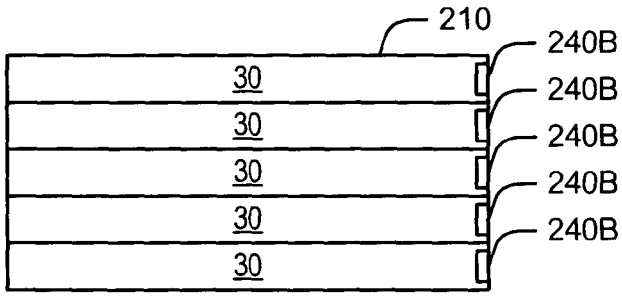

In order to provide more extensive data regarding light output characteristics of the lighting panel 40, more than one photosensor 240B may be used. For example, as shown in FIG. 6B, there may be one photosensor 240B per bar assembly 30. In that case, the photosensors 240B may be located at ends of the bar assemblies 30 and may be arranged to receive an average/combined amount of light emitted from the bar assembly 30 with which they are associated.

Figure 6C:
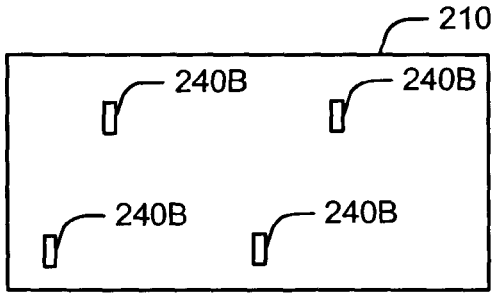
Figure 6D:
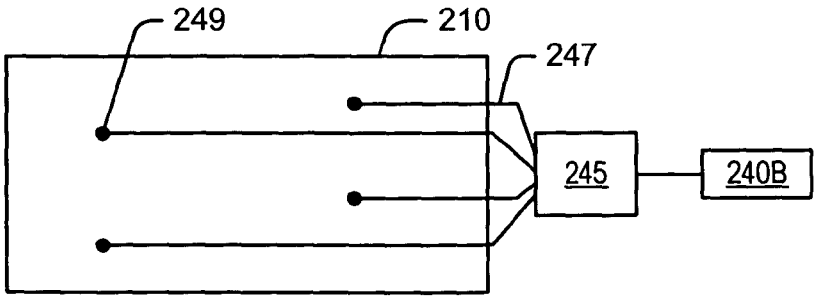

As shown in FIG. 6C, photosensors 240B may be arranged at one or more locations within a periphery of the light emitting region of the lighting panel 40. However in some embodiments, the photosensors 240B may be located away from the light emitting region of the lighting panel 40, and light from various locations within the light emitting region of the lighting panel 40 may be transmitted to the sensors 240B through one or more light guides. For example, as shown in FIG. 6D, light from one or more locations 249 within the light emitting region of the lighting panel 40 is transmitted away from the light emitting region via light guides 247, which may be optical fibers that may extend through and/or across the tiles 10. In the embodiments illustrated in FIG. 6D, the light guides 247 terminate at an optical switch 245, which selects a particular guide 247 to connect to the photosensor 240B based on control signals from the controller 230 and/or from the color management unit 260. It will be appreciated, however, that the optical switch 245 is optional, and that each of the light guides 245 may terminate at a photosensor 240B. In further embodiments, instead of an optical switch 245, the light guides 247 may terminate at a light combiner, which combines the light received over the light guides 247 and provides the combined light to a photosensor 240B. The light guides 247 may extend across partially across, and/or through the tiles 10. For example, in some embodiments, the light guides 247 may run behind the panel 40 to various light collection locations and then run through the panel at such locations. Furthermore, the photosensor 240B may be mounted on a front side of the panel (i.e. on the side of the panel 40 on which the lighting devices 16 are mounted) or on a reverse side of the panel 40 and/or a tile 10 and/or bar assembly 30.

Figure 7:
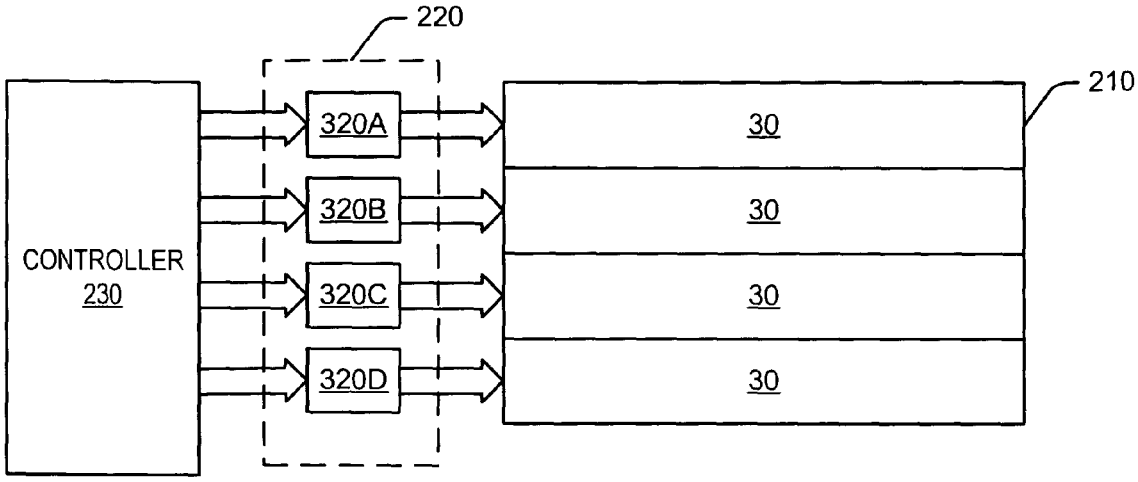
FIGS. 7-8 are schematic diagrams illustrating elements of a lighting panel system according to some embodiments of the invention.
Figure 8:
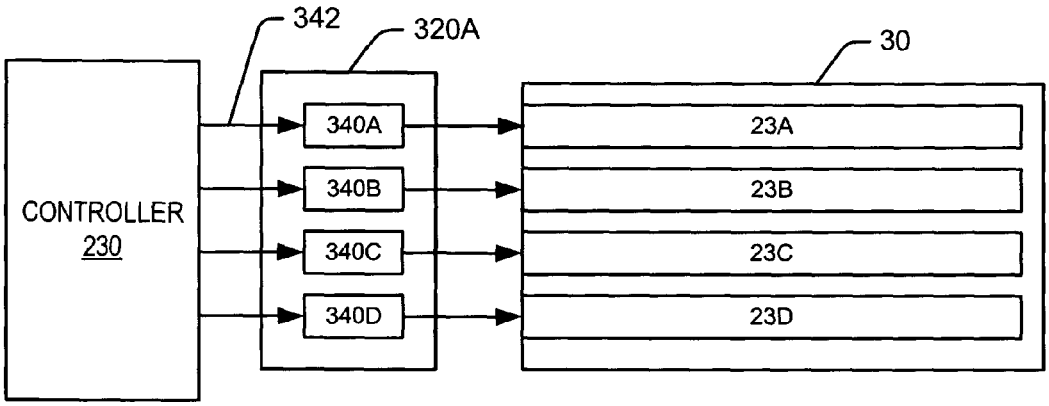

Referring now to FIG. 7, a current driver 220 may include a plurality of bar driver circuits 320A-320D. One bar driver circuit 320A-320D may be provided for each bar assembly 30 in a lighting panel 40. In the embodiments shown in FIG. 7, the lighting panel 40 includes four bar assemblies 30. However, in some embodiments the lighting panel 40 may include nine bar assemblies 30, in which case the current driver 220 may include nine bar driver circuits 320. As shown in FIG. 8, in some embodiments, each bar driver circuit 320 may include four current supply circuits 340A-340D, i.e., one current supply circuit 340A-340D for each LED string 23A-23D of the corresponding bar assembly 30. Operation of the current supply circuits 340A-340B may be controlled by control signals 342 from the controller 230.

Figure 9:
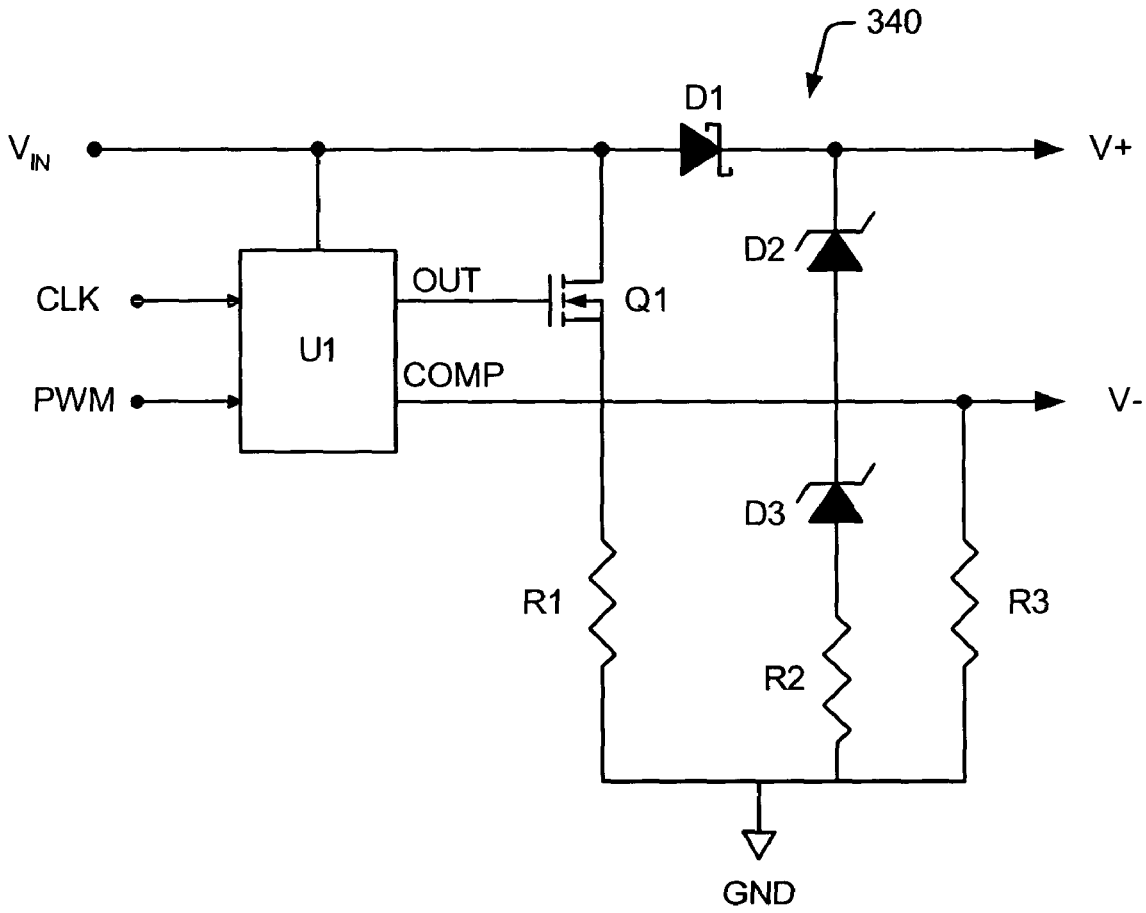
FIG. 9 is a schematic circuit diagram of a current supply circuit according to some embodiments of the invention.

A current supply circuit 340 according to some embodiments of the invention is illustrated in more detail in FIG. 9. As shown therein, a current supply circuit 340 may include a PWM controller U1, a transistor Q1, resistors R1-R3 and diodes D1-D3 arranged as shown in FIG. 9. The current supply circuit 340 receives an input voltage Vin. The current supply circuit 340 also receives a clock signal CLK and a pulse width modulation signal PWM from the controller 230. The current supply circuit 340 is configured to provide a substantially constant current to a corresponding LED string 23 via output terminals V+ and V−, which are connected to the anode and cathode of the corresponding LED string, respectively. The constant current may be supplied with a variable voltage boost to account for differences in average forward voltage from string to string. The PWM controller U1 may include, for example, an LM5020 Current Mode PWM controller from National Semiconductor Corporation.

The current supply circuit 340 is configured to supply current to the corresponding LED string 13 while the PWM input is a logic HIGH. Accordingly, for each timing loop, the PWM input of each current supply circuit 340 in the driver 220 is set to logic HIGH at the first clock cycle of the timing loop. The PWM input of a particular current supply circuit 340 is set to logic LOW, thereby turning off current to the corresponding LED string 23, when a counter in the controller 230 reaches the value stored in a register of the controller 230 corresponding to the LED string 23. Thus, while each LED string 23 in the lighting panel 40 may be turned on simultaneously, the strings may be turned off at different times during a given timing loop, which would give the LED strings different pulse widths within the timing loop. The apparent brightness of an LED string 23 may be approximately proportional to the duty cycle of the LED string 23, i.e., the fraction of the timing loop in which the LED string 23 is being supplied with current.

An LED string 23 may be supplied with a substantially constant current during the period in which it is turned on. By manipulating the pulse width of the current signal, the average current passing through the LED string 23 may be altered even while maintaining the on-state current at a substantially constant value. Thus, the dominant wavelength of the LEDs 16 in the LED string 23, which may vary with applied current, may remain substantially stable even though the average current passing through the LEDs 16 is being altered. Similarly, the luminous flux per unit power dissipated by the LED string 23 may remain more constant at various average current levels than, for example, if the average current of the LED string 23 was being manipulated using a variable current source.

The value stored in a register of the controller 230 corresponding to a particular LED string may be based on a value received from the color management unit 260 over the communication link 235. Alternatively and/or additionally, the register value may be based on a value and/or voltage level directly sampled by the controller 230 from a sensor 240.

In some embodiments, the color management unit 260 may provide a value corresponding to a duty cycle (i.e. a value from 0 to 100), which may be translated by the controller 230 into a register value based on the number of cycles in a timing loop. For example, the color management unit 260 indicates to the controller 230 via the communication link 235 that a particular LED string 23 should have a duty cycle of 50%. If a timing loop includes 10,000 clock cycles, then assuming the controller increments the counter with each clock cycle, the controller 230 may store a value of 5000 in the register corresponding to the LED string in question. Thus, in a particular timing loop, the counter is reset to zero at the beginning of the loop and the LED string 23 is turned on by sending an appropriate PWM signal to the current supply circuit 340 serving the LED string 23. When the counter has counted to a value of 5000, the PWM signal for the current supply circuit 340 is reset, turning the LED string off.

In some embodiments, the pulse repetition frequency (i.e. pulse repetition rate) of the PWM signal may be in excess of 60 Hz. In particular embodiments, the PWM period may be 5 ms or less, for an overall PWM pulse repetition frequency of 200 Hz or greater. A delay may be included in the loop, such that the counter may be incremented only 100 times in a single timing loop. Thus, the register value for a given LED string 23 may correspond directly to the duty cycle for the LED string 23. However, any suitable counting process may be used provided that the brightness of the LED string 23 is appropriately controlled.

The register values of the controller 230 may be updated from time to time to take into account changing sensor values. In some embodiments, updated register values may be obtained from the color management unit 260 multiple times per second.

Furthermore, the data read from the color management unit 260 by the controller 230 may be filtered to limit the amount of change that occurs in a given cycle. For example, when a changed value is read from the color management unit 260, an error value may be calculated and scaled to provide proportional control ("P"), as in a conventional PID (Proportional-Integral-Derivative) feedback controller. Further, the error signal may be scaled in an integral and/or derivative manner as in a PID feedback loop. Filtering and/or scaling of the changed values may be performed in the color management unit 260 and/or in the controller 230.

Figure 10:
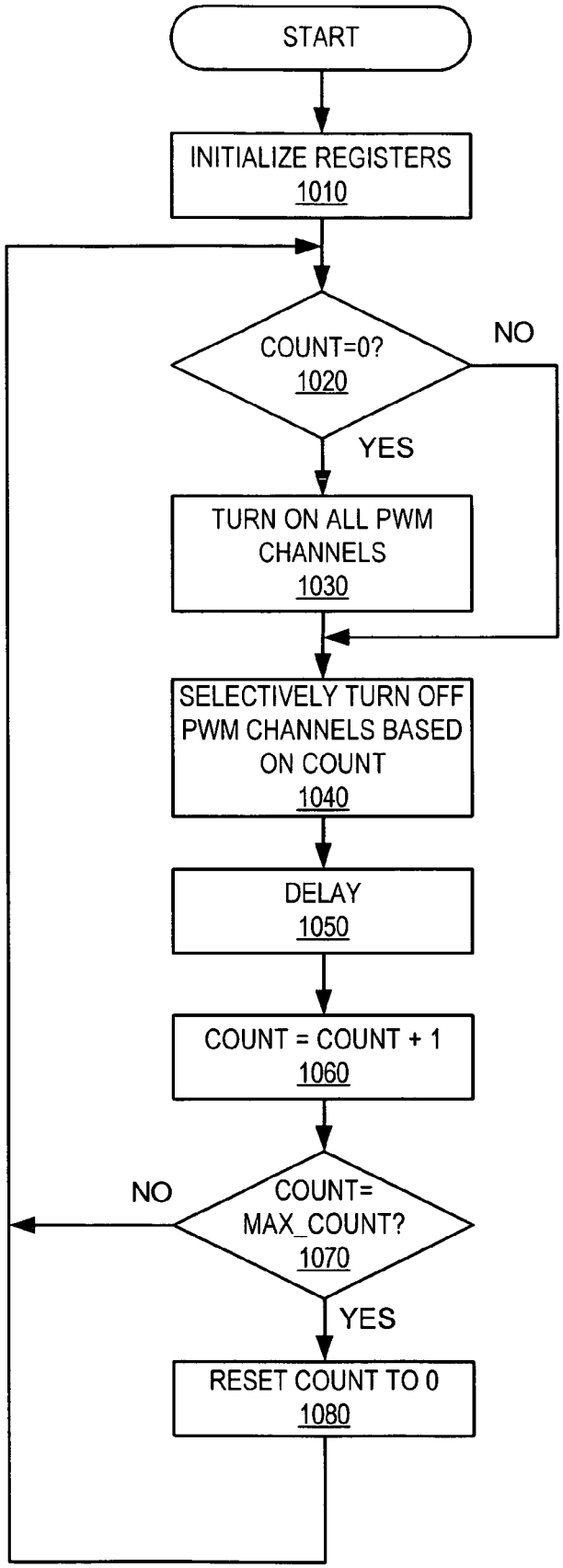
FIGS. 10-13B are flowchart diagrams illustrating operations according to some embodiments of the invention.
Figure 11:
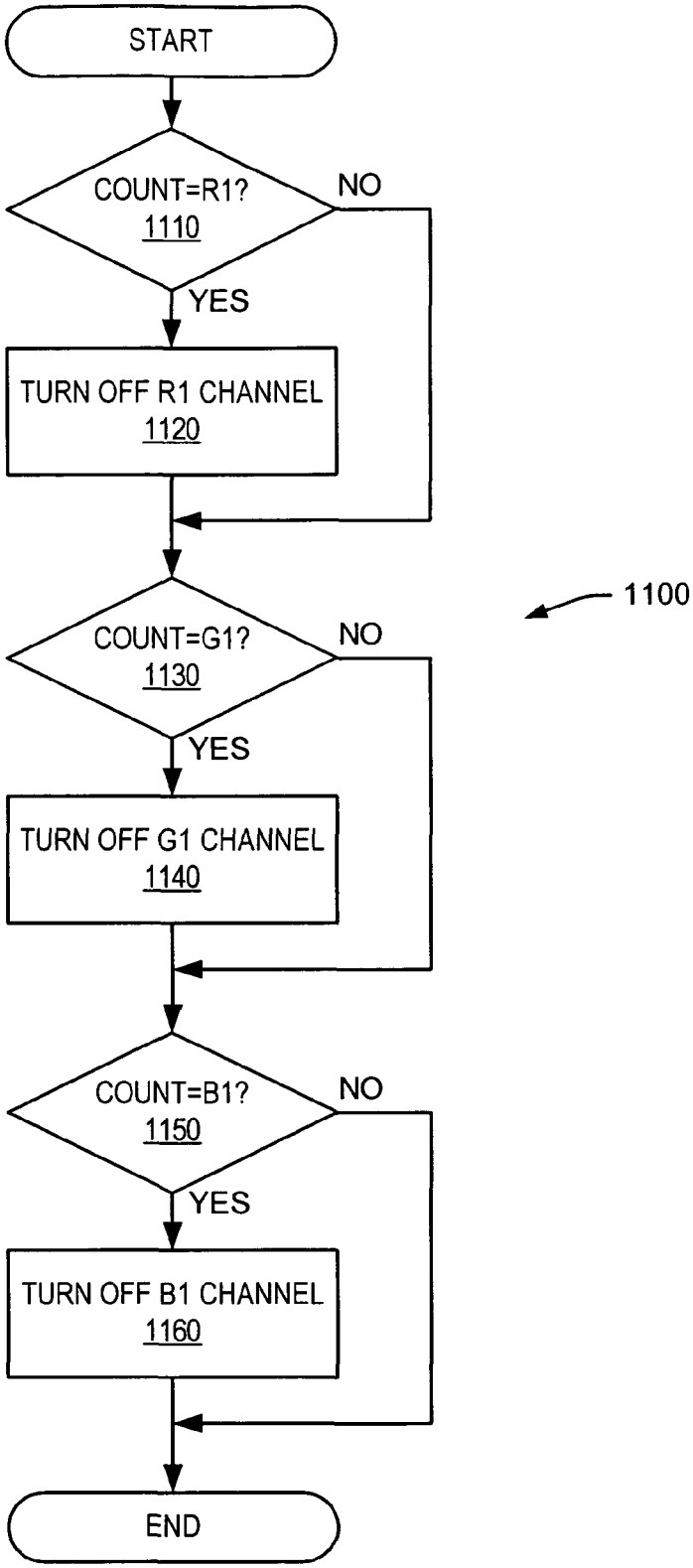
Figure 12:
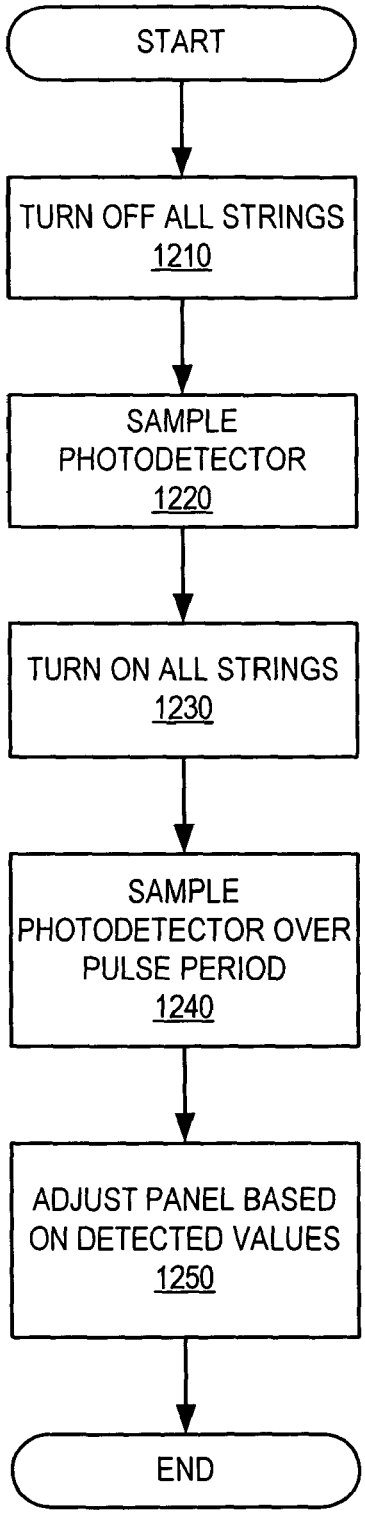

Operations of some elements of the display system 200 are illustrated in FIGS. 10-12. Referring to FIG. 11, the string registers in the controller 230 are initialized (block 1010). The initial register values may be stored in a non-volatile memory, such as a read-only memory (ROM), a non-volatile random access memory (NVRAM) or other storage device accessible by the controller 230. The counter COUNT in the controller 230 is also reset to zero.

Control then passes to block 1020, which determines if the counter COUNT is equal to zero. If so, the PWM outputs of each of the control lines 342 are set to logic HIGH (block 1030). If not, block 1030 is bypassed. The controller 230 then selectively turns off the PWM output of any LED string whose register value is equal to COUNT (block 1040). An optional delay is then introduced (block 1050), and the COUNT value is incremented (block 1060). Control then passes to block 1070, which determines if the COUNT has reached a maximum value, which in some embodiments may be 100. If not, control passes to block 1020. If the value of COUNT has reached the maximum value MAX_COUNT, the current timing loop has ended, and COUNT is reset to 0.

Referring now to FIG. 11, operations associated with selectively turning off the PWM signals for each of the LED strings 23 is illustrated as a process 1100, which is repeated for each group of red, green and blue strings 23 in a display unit 40. For example, the process 1100 may be repeated once for each bar assembly 30 of a lighting panel 40. As shown in FIG. 11, the controller 230 first determines if the count is equal to the register value of the red string register R1 (block 1110). If so, the PWM signal associated with the register R1 is set to logic low, thereby turning off the LED string 23 associated therewith (block 1120). Next, the controller 230 determines if the count is equal to the register value of the first green string register G1A (block 1130). If so, the PWM signal associated with the register G1A is set to logic low, thereby turning off the LED string or strings 23 associated therewith (block 1140). The same process may be repeated for the second green string register G1B. Alternatively, a single register may be used for both green strings. Finally, the controller 230 determines if the count is equal to the register value of the blue string register B1 (block 1150). If so, the PWM signal associated with the register B1 is set to logic low, thereby turning off the LED string 23 associated therewith (block 1160). The process 1100 is repeated for each bar assembly 30 in the lighting panel 40.

In some embodiments, the controller 230 may cause the color management unit 260 to sample a photosensor 240B when the lighting panel 40 is momentarily dark (i.e. when all of the light sources within the unit are momentarily switched off) in order to obtain a measure of ambient light (e.g. a dark signal value). The controller 230 may also cause the color management unit 260 to sample the photosensor 240B during a time interval in which the display is lighted for at least a portion of the interval in order to obtain a measure of the display brightness (e.g. a light signal value). For example, the controller 230 may cause the color management unit 260 to obtain a value from the photosensor that represents an average over an entire timing loop.

For example, referring to FIG. 12, all LED strings in the lighting panel 40 are turned off (block 1210), and the photosensor 240B output is sampled to obtain a dark signal value (block 1220). The LED strings are then energized (block 1230), and the display output is integrated over an entire pulse period and sampled (block 1240) to obtain a light signal value. The output of the lighting panel 40 is then adjusted based on the dark signal value and/or the light signal value (block 1250)

The brightness of the lighting panel 40 may be adjusted to account for differences in ambient light. For example, in situations in which the level of ambient light is high, the brightness of the lighting panel 40 may be increased via a positive feedback signal in order to maintain a substantially consistent contrast ratio. In other situations in which the level of ambient light is low, a sufficient contrast ratio may be maintained with a lower brightness, so the display brightness may be decreased by a negative feedback signal.

As explained above, the brightness of the lighting panel 40 may be adjusted by adjusting the pulse widths of the current pulses for one or more (or all) of the LED strings 23 in the lighting panel 40. In some embodiments, the pulse widths may be adjusted based on a difference between the sensed display brightness and the sensed ambient brightness. In other embodiments, the pulse widths may be adjusted based on a ratio of the sensed display brightness (the light signal value) to the sensed ambient brightness (the dark signal value).

Accordingly, in some embodiments, the feedback loop formed by the lighting panel 40, the photosensor 240B, the color management unit 260 and the controller 230 may tend to maintain the average luminosity of the lighting panel 40 independent of ambient illumination. In other embodiments, the feedback loop may be configured to maintain a desired relationship between the average luminosity of the lighting panel 40 and the level of ambient illumination.

In some embodiments, the feedback loop may employ digital incremental logic. The digital incremental logic of the feedback loop may reference indices of a lookup table including a list of values such as duty cycle values.

As indicated above, in some embodiments of the invention, each of the PWM signals may be set to logic HIGH at the same time (i.e. at the beginning of a timing loop). In that case, all of the LEDs in the display will turn on at the same time within a given timing loop, but will turn off at different times depending on the register values associated with the various LED strings 23 in the lighting panel 40. However, in other embodiments, the turn-on of one or more of the LED strings 23 may be staggered, so that all of the LED strings 23 are not being turned on simultaneously. In some cases, the PWM signal of at least one of the LED strings 23 may be delayed by a fixed and/or variable delay that causes the LED string 23 to turn on at a different time from other LED strings 23. The delay may be provided in software, for example by providing an offset value that may be added to the register value. The offset value may be examined before the LED string is turned on.

Thus, for example, each LED string may have two associated values representing a start time and a stop time, or, alternatively, a start time and a duration. For example, the controller may maintain two values (START and STOP) for each LED string 23. At the entry of the timing loop, all PWM values may be reset to logic LOW. In each cycle of the timing loop, the value of COUNT is compared to START. If the value of COUNT is greater than or equal to START, but less than the value of STOP, the PWM signal for the LED string 23 is turned/maintained at logic HIGH. However, if the value of COUNT is greater than STOP, the PWM signal for the LED string is reset to logic LOW.

In some embodiments, the timing delay (e.g. the value of START) may be fixed at a different level for each LED string 23 and/or groups of LED strings 23. For example, timing delays may be set such that one red LED string 23A has a different START value than another red LED string 23A.

In further embodiments, a timing delay for each LED string may be randomly generated. The random timing delay may be generated for each timing loop and/or after a given number of timing loops have elapsed. A random delay may be provided within a minimum bound and a maximum bound. The minimum bound may be zero, and the maximum bound for a given LED string 23 may be the maximum count MAX_COUNT minus the string register value for the LED string 23 in question. For example, a pulse with a 60% duty cycle may be delayed by no more than 40% of the pulse period. This may ensure that the LED string 23 will remain on for the full pulse width, even if it is delayed.

By staggering the timing delays of the LED strings 23, in a fixed or random fashion, all of the LED strings 23 may not switched from an off-state to an on-state simultaneously, which may reduce flicker and/or combined amplitude in the light output from the lighting panel 40 and/or may balance an external power factor of the lighting panel 40.

Other methods may be employed in order to control the average luminosity of an LED string 23 and/or the lighting panel 40. For example, instead of using pulse width modulation, a system may employ pulse frequency modulation. Modifications to the controller 230 and/or current driver 220 in order to accommodate pulse frequency modulation are generally known to those skilled in the art.

Same colored LED strings in a lighting panel need not be driven with the same pulse width. For example, a backlight panel 40 may include a plurality of red LED strings 23, each of which may be driven with a different pulse width, resulting in a different average current level. Accordingly, some embodiments of the invention provide a closed loop digital control system for a lighting panel, such as an LCD backlight, that includes first and second LED strings 23 that include a plurality of LED chips 16 therein that emit narrow band optical radiation having a first dominant wavelength when energized, and third and fourth LED strings 23 that include a plurality of LED chips 16 that emit narrow band optical radiation having a second dominant wavelength, different from the first dominant wavelength.

In some embodiments, the first and second LED strings 23 are maintained at a different average current level than one another yet are driven at substantially the same on-state current. Likewise, the third and fourth LED strings are maintained at different average current levels than one another yet are driven at substantially the same on-state current.

The on-state current of the first and second LED strings 23 may be different than the on-state current of the third and fourth LED strings. For example, the on-state current used to drive red LED strings 23 may be different than the on-state current used to drive green and/or blue LED strings. The average current of a string 23 is proportional to the pulse width of the current through the string 23. The ratio of average current between the first and second LED strings 23 may be maintained relatively constant, and/or the ratio of average current between the third and fourth LED strings 23 may be maintained relatively constant. Furthermore, the ratio of average current between the first and second LED strings 23 compared to the average current of the third and fourth LED strings 23 may be allowed to change as part of the closed loop control in order to maintain a desired display white point.

Some embodiments of the invention provide an LCD backlight for an LCD display having a visible area with a diagonal size greater than 17". The LCD backlight includes a plurality of digitally controlled strings of red, green and blue emitting LEDs are arranged in a two-dimensional region that is substantially parallel to a display surface of the LCD display. The LEDs in the array are arranged within an area that is greater than about 30% of the visible area of the LCD display. The average power dissipated by the LEDs, compared to the bounding extents of the two-dimensional region in which they are arranged may be less than about 0.3 Watts per square inch. The average luminance of the LCD backlight system at maximum brightness adjustment may be greater than 200 Nit at 22 degrees C. ambient temperature when set to a white point with a correlated color temperature (CCT) of between 4000k and 8000k, but more preferably is greater than about 250 nit or more. In one LCD display backlight embodiment with the display set at a white point corresponding to the D65 illuminant, the display luminance is greater than 280 nits, the total LED power dissipation is less than 110 watts, the luminous flux emitted by the LED backlight is about 4775 lumens, the visible display area is about 384 square inches and the area of the boundary surrounding the LED array is about 338 square inches. This same embodiment includes about 432 RGB solid state lighting elements disposed on 54 tiles.

In some embodiments, the average luminous flux from LEDs of a given color (e.g. red, green or blue) that are nearest the edge of the display may be greater than the average luminous flux from LEDs of that color across the entirety of the LED arrays.

Furthermore, the average power dissipated by LEDs of a given color (e.g. red, green or blue) that are nearest the edge of the display may be greater than the average power dissipated by LEDs of that color across the entirety of the LED arrays.

In some embodiments, the average power dissipated by LEDs nearest the bottom of the display of a given color is greater than the average power dissipated by LEDs of that color nearest the top of the display.

Furthermore, the average luminous flux generated per unit of power dissipated at a given junction temperature for LEDs nearest the bottom of the display of a given color may be less than the average luminous flux generated per unit of power dissipated at a given junction temperature for LEDs of that color nearest the top of the display.

In some embodiments, the on-state current level provided to a given LED string 23 may be adjusted by the current supply circuit 340 in response to commands from the controller 230. In that case, a particular LED string may be driven at an on-state current level selected to adjust a dominant wavelength of a particular LED string 23. For example, due to chip-to-chip variations in dominant wavelength, a particular LED string 23 may have an average dominant wavelength that is higher than an average dominant wavelength of other LED strings 23 of the same color within a lighting panel 40. In that case, it may be possible to drive the higher-wavelength LED string at a slightly higher on-state current, which may cause the dominant wavelength of the LED string 23 to drop and better match that of the shorter-wavelength LED strings 23.

In some embodiments, the initial on-state drive currents of each of the LED strings 23 may be calibrated by a calibration process in which each of the LED strings is individually energized and the light output from each string is detected using the photosensor 240A. The dominant wavelength of each string may be measured, and an appropriate drive current may be calculated for each LED string in order to adjust the dominant wavelength as necessary. For example, the dominant wavelengths of each of the LED strings 23 of a particular color may be measured and the variance of the dominant wavelengths for a particular color may be calculated. If the variance of the dominant wavelengths for the color is greater than a predetermined threshold, or if the dominant wavelength of a particular LED string 23 is higher or lower than the average dominant wavelength of the LED strings 23 by a predetermined number of standard deviations, then the on-state drive current of one or more of the LED strings 23 may be adjusted in order to reduce the variance of dominant wavelengths. Other methods/algorithms may be used in order to correct/account for differences in dominant wavelength from string to string.

Figure 13A:
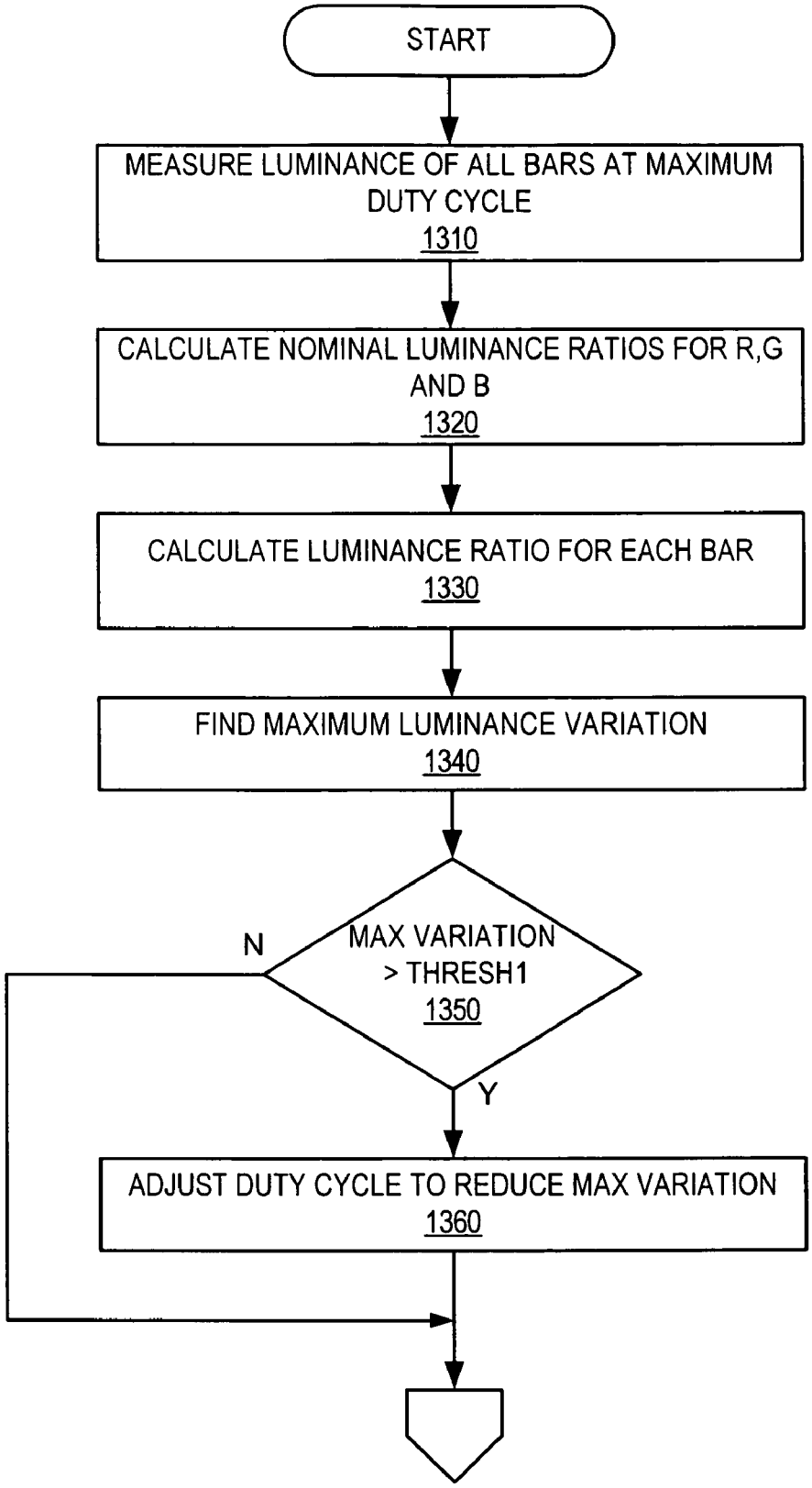
Figure 13B:
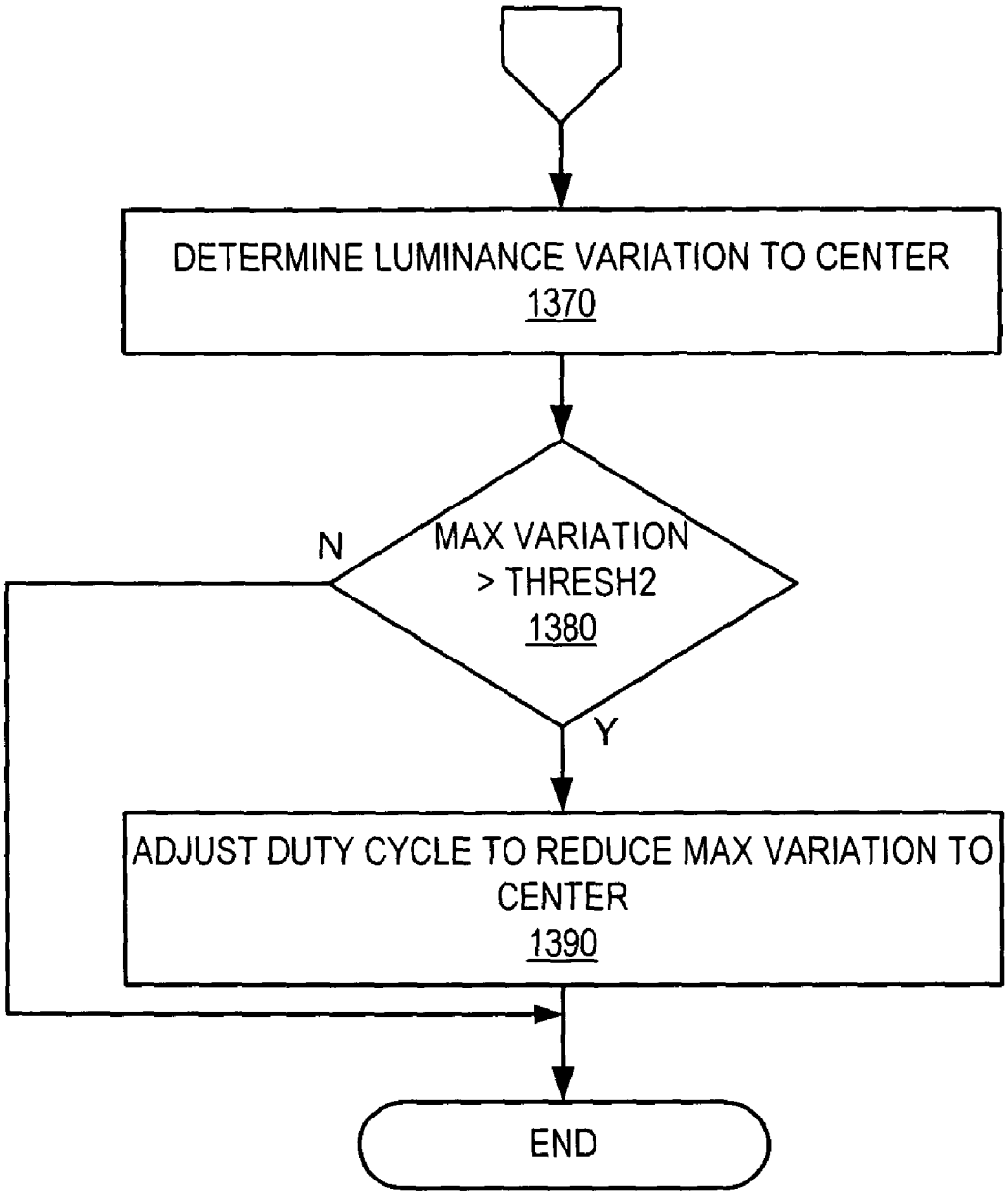

FIGS. 13A-13B are flowchart diagrams that illustrate operations according to some embodiments of the invention associated with calibrating a lighting panel 40 having M segments, such as bars 30, each of which may include a group of tiles 10. The lighting panel 40 may be calibrated by measuring the light output by the bars 30 from N different locations. In some embodiments, the number of bars 30 may be 9 (i.e. M=9), and/or the number of measurement locations N may be 3. As illustrated in FIG. 13A, the luminance of all bars is measured at maximum duty cycle for each color (block 1310). That is, the red LEDs of each bar 30 are sequentially energized at a 100% duty cycle, and N measurements are taken for each bar. The measurements may include measurement of total luminance Y of each bar m ϵ [1 . . . M] for each color (R, G, B) and each measurement location n ϵ [1 . . . N]. The CIE chromaticity (x, y) may also be measured for each bar/color/location. Measurements may be taken using, for example, a PR-650 SpectraScan® Colorimeter from Photo Research Inc., which can be used to make direct measurements of luminance, CIE Chromaticity (1931 xy and 1976 u'v') and/or correlated color temperature.

Next, nominal luminance ratios are calculated for each color (block 1320). In order to calculate nominal luminance ratios, total luminance values for each color $Y_{R,total}$, $Y_{G,total}$, and $Y_{B,total}$ are calculated as follows:

$$Y_{R,total} = \sum_{m,n} Y_{Rmn} \tag{1a}$$

$$Y_{G,total} = \sum_{m,n} Y_{Gmn} \tag{1b}$$

$$Y_{B,total} = \sum_{m,n} Y_{Bmn} \tag{1c}$$

The nominal RGB luminance ratios may then be calculated as follows:

$$Y_{R\backslash ratio}=Y_{R,total}/(Y_{R,total}+Y_{G,total}+Y_{B,total}) \tag{2a}$$

$$Y_{G\backslash ratio}=Y_{G,total}/(Y_{R,total}+Y_{G,total}+Y_{B,total}) \tag{2b}$$

$$Y_{B\backslash ratio}=Y_{B,total}/(Y_{R,total}+Y_{G,total}+Y_{B,total}) \tag{2c}$$

Next, a luminance ratio is calculated for each bar (block 1330), as follows. First, a total luminance is calculated for each bar as follows:

$$Y_{Rm,total} = \sum_{n} Y_{Rmn} \tag{3a}$$

$$Y_{Gm,total} = \sum_{n} Y_{Gmn} \tag{3b}$$

$$Y_{Bm,total} = \sum_{n} Y_{Bmn} \tag{3c}$$

Then, a luminance ratio for each bar is calculated as follows:

$$Y_{Rm\backslash ratio}=Y_{Rm,total}/(Y_{Rm,total}+Y_{Gm,total}+Y_{Bm,total}) \tag{4a}$$

$$Y_{Gm\backslash ratio}=Y_{Gm,total}/(Y_{Rm,total}+Y_{Gm,total}+Y_{Bm,total}) \tag{4b}$$

$$Y_{Bm\backslash ratio}=Y_{Bm,total}/(Y_{Rm,total}+Y_{Gm,total}+Y_{Bm,total}) \tag{4c}$$

A maximum variation from the nominal luminance ratio may then be obtained (block 1340) by calculating a variation from the nominal luminance ratio for each color and for each bar as follows:

$$\Delta Y_{Rm\backslash ratio}=(Y_{Rm\backslash ratio}-Y_{R\backslash ratio})/Y_{R\backslash ratio} \tag{5a}$$

$$\Delta Y_{Gm\backslash ratio}=(Y_{Gm\backslash ratio}-Y_{G\backslash ratio})/Y_{G\backslash ratio} \tag{5a}$$

$$\Delta Y_{Bm\backslash ratio}=(Y_{Bm\backslash ratio}-Y_{B\backslash ratio})/Y_{B\backslash ratio} \tag{5a}$$

The maximum variation from the nominal luminance ratio may then be obtained as follows:

$$\Delta Y_{m\backslash ratio,max}=\max(\Delta Y_{Rm\backslash ratio}, \Delta Y_{Gm\backslash ratio}, \Delta Y_{Bm\backslash ratio}) \tag{6}$$

If in block 1350 it is determined that the maximum variation from the nominal luminance ratio is greater than a first threshold THRESH1, then the duty cycles of the bars/colors are adjusted to reduce the maximum variation from the nominal luminance ratio (block 1360) to below the first threshold THRESH1. The first threshold THRESH1 may be less than 1%. For example, the first threshold THRESH1 may be 0.4% in some embodiments.

The duty cycles of the bars/colors may be adjusted by first selecting the color with the lowest relative luminance as follows:

$$\Delta Y_{Km\backslash ratio,min}=\min(\Delta Y_{Rm\backslash ratio}, \Delta Y_{Gm\backslash ratio}, \Delta Y_{Bm\backslash ratio}) \tag{7}$$

where K=R, G or B; color K has the lowest relative luminance. A duty cycle coefficient is then calculated for each bar to provide color uniformity as follows:

$$C_{Km}=Y_{Km\backslash ratio}/Y_{K\backslash ratio} \tag{8}$$

where K=R, G or B; color K has the lowest relative luminance.

The duty cycles (DC) for each color/bar are then adjusted for color balance as follows:

$$DC_{Rm}=C_{Km}*Y_{R\backslash ratio}/Y_{Rm\backslash ratio} \tag{9a}$$

$$DC_{Gm}=C_{Km}*Y_{G\backslash ratio}/Y_{Gm\backslash ratio} \tag{9b}$$

$$DC_{Bm}=C_{Km}*Y_{B\backslash ratio}/Y_{Bm\backslash ratio} \tag{9c}$$

Referring now to FIG. 13B, the calibration process is continued by determining the luminance variation to center points of the display (block 1370). First, the luminance after color balance (duty cycle adjustment) for each bar/color/measurement point is calculated as follows:

$$Y_{Rmn}=DC_{Rm}*Y_{Rmn} \tag{10a}$$

$$Y_{Gmn}=DC_{Gm}*Y_{Gmn} \quad (10b)$$

$$Y_{Bmn}=DC_{Bm}*Y_{Bmn} \quad (10c)$$

The RGB mixed luminance is then calculated for each position as follows:

$$Y_{mn}=Y_{Rmn}+Y_{Gmn}+Y_{Bmn} \quad (11)$$

for each of M bars (m ϵ [1 . . . M]) and N measurement positions (n ϵ [1 . . . N]).

Assuming M=9 and N=3, a center luminance average may be calculated as follows:

$$Y_{center}=(Y_{52}+Y_{72}+Y_{32})/3 \quad (12)$$

A luminance variation to the center luminance average may then be calculated for each bar/measurement position as follows:

$$\Delta Y_{mn}=[Y_{mn}-\max(Y_{mn})]/Y_{center} \quad (13)$$

The maximum variation to the center luminance is then compared in block 1380 to a second threshold THRESH2, which may be, for example, 10%. If the maximum variation to the center luminance exceeds the second threshold THRESH2, then the duty cycles are again adjusted to reduce the maximum variation to the center luminance (block 1390). First, a uniformity coefficient is calculated for each bar as follows:

$$C_m=[1-\min(\Delta Y_{m1}, \ldots, \Delta Y_{mn})]/1.1 \quad (14)$$

A new duty cycle is then calculated as follows:

$$DC_{Rm}=C_m*DC_{Rm} \quad (15a)$$

$$DC_{Gm}=C_m*DC_{Gm} \quad (15b)$$

$$DC_{Bm}=C_m*DC_{Bm} \quad (15c)$$

The maximum duty cycle of all bars/colors is then determined as follows:

$$DC_{max}=\max(DC_{Km}) \quad (16)$$

where K=R, G or B, and m ϵ [1 . . . M].

The duty cycles may then be re-normalized such that the maximum duty cycle is 100% as follows:

$$DC_{Rm}=DC_{Rm}/DC_{max} \quad (17a)$$

$$DC_{Gm}=DC_{Gm}/DC_{max} \quad (17b)$$

$$DC_{Bm}=DC_{Bm}/DC_{max} \quad (17c)$$

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A lighting panel system, comprising:

a lighting panel comprising first and second pulsed LED light sources configured to emit narrow band optical radiation having a first dominant wavelength when energized and third and fourth pulsed LED light sources configured to emit narrow band optical radiation having a second dominant wavelength when energized, the second dominant wavelength being different from the first dominant wavelength;

a photosensor configured to be responsive to the first and second dominant wavelengths and configured to provide substantially independent outputs related to the sensed illumination levels in the first and second dominant wavelengths first, second, third and fourth current sources configured to supply current to the first, second, third and fourth pulsed LED light sources, respectively, in response to control signals; and a control system coupled to the lighting panel and to the photosensor and configured to provide a feedback loop from the photosensor to the lighting panel by sampling the photosensor output, and, responsive to the photosensor output samples, providing the control signals to the first and second current sources to adjust an average current supplied to at least the first and second pulsed LED light sources, wherein the control system is further configured to maintain the first and second pulsed LED light sources at different average current levels from one another and to maintain the third and fourth pulsed LED light sources at different average current levels than one another;

wherein the current sources are configured to provide a first on-state current level to the first and second pulsed LED light sources and to provide a second on-state current level, different from the first on-state current level, to the third and fourth pulsed LED light sources; and wherein the control system is further configured to maintain a ratio of average current levels between the first and second pulsed LED light sources relatively constant while varying the average current level to the first and second pulsed LED light sources and without appreciably changing the on-state current of the first and second pulsed LED light sources.

2. The lighting panel system of claim 1, wherein the control system is further configured to maintain a ratio of average current levels between the third and fourth pulsed LED light sources relatively constant while varying the average current level to the third and fourth pulsed LED light sources and without appreciably changing the on-state current of the third and fourth pulsed LED light sources.

3. The lighting panel system of claim 1, wherein the control system is configured to alter average current levels of the first and second pulsed LED light sources in order to maintain a white point of the lighting panel.

4. A lighting panel system, comprising:

a lighting panel including at least first and second groups of solid state lighting devices configured to emit light having a first color in response to respective first and second drive currents therethrough and a third group of solid state lighting devices configured to emit light having a second color, different from the first color, in response to a third drive current therethrough;

a current supply circuit configured to supply the respective first, second and third drive currents to the first, second and third groups of solid state lighting devices in response to respective control signals;

a control system configured to generate the respective control signals, wherein the control system is configured to cause the current supply circuit to drive the first and second groups of solid state lighting devices at different average current levels; and a fourth group of solid state lighting devices configured to emit light having the second color in response to a fourth drive current therethrough, wherein the control system is further configured to cause the current supply circuit to drive the third and fourth groups of solid state lighting devices at different average current levels.

5. The lighting panel system of claim 4, wherein the first and second drive currents comprise pulse width modulated current signals, and wherein the control system is further configured to maintain a ratio of average levels of the first and second drive currents relatively constant while varying the average levels of the first and second drive currents without appreciably changing on-state current levels of current supplied to the first and second groups of solid state lighting devices.

6. The lighting panel system of claim 4, wherein the lighting panel comprises first and second bar assemblies arranged to form a lighting surface, wherein the first and third groups of solid state lighting devices are on the first bar assembly and the second group of solid state lighting devices is on the second bar assembly.

7. The lighting panel system of claim 6, wherein the first bar assembly is free of the second group of solid state lighting devices and the second bar assembly is free of the first and third groups of solid state lighting devices.

8. The lighting panel system of claim 4, wherein the first group of solid state lighting devices occupies a first region of the lighting panel and the second group of solid state lighting devices occupies a second region of the lighting panel that is different from the first region of the lighting panel.

9. The lighting panel system of claim 4, wherein the control system is configured to alter average current levels of the first and second groups of solid state lighting devices in order to maintain a color point of a combined light emitted by the lighting panel.

10. The lighting panel system of claim 4, wherein the control signals comprise pulse width modulation (PWM) signals, and wherein the control system is configured to control the average current levels supplied to the first and second groups by varying duty cycles of the PWM signals.

11. The lighting panel system of claim 4, wherein the first, second and third groups of solid state lighting devices comprise respective first, second and third strings of series connected light emitting diodes.

* * * * *